US011612193B2

(12) United States Patent
Dowdle

(10) Patent No.: US 11,612,193 B2
(45) Date of Patent: Mar. 28, 2023

(54) GARMENTS, FOR EXAMPLE BRASSIERES, EMPLOYING ELASTOMERS, FOR EXAMPLE SILICONE, AND METHODS OF MANUFACTURING SAME

(71) Applicant: KELYNNSHER LLC, Dallas, TX (US)

(72) Inventor: Kelly Dowdle, Dallas, TX (US)

(73) Assignee: Kelynnsher LLC, Dallas, TX (US)

( * ) Notice: Subject to any disclaimer, the term of this patent is extended or adjusted under 35 U.S.C. 154(b) by 514 days.

(21) Appl. No.: 16/642,712

(22) PCT Filed: Aug. 29, 2018

(86) PCT No.: PCT/US2018/048496
§ 371 (c)(1),
(2) Date: Feb. 27, 2020

(87) PCT Pub. No.: WO2019/046394
PCT Pub. Date: Mar. 7, 2019

(65) Prior Publication Data

US 2020/0229513 A1 Jul. 23, 2020

Related U.S. Application Data

(60) Provisional application No. 62/552,219, filed on Aug. 30, 2017.

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
See application file for complete search history.

(56) References Cited

U.S. PATENT DOCUMENTS 563,408 A 7/1896 Pfister
2,130,906 A 9/1938 Jacob
(Continued)

FOREIGN PATENT DOCUMENTS

AU 2010200001 B2 2/2016
CA 2622591 A1 3/2007
(Continued)

OTHER PUBLICATIONS

8-Inch Zip-N-Trim Support Boxer Brief, retrieved from http://www.underworks.com/8-inch-zip-n-trim-support-boxer-brief on Jun. 16, 2017, in 7 pages.
(Continued)

*Primary Examiner* — Gloria M Hale
(74) *Attorney, Agent, or Firm* — Cozen O'Connor

(57) ABSTRACT

A garment may be summarized as including: at least one non-toxic elastomeric sheet, at least one non-toxic textile sheet, and stitches that physically couple the non-toxic elastomeric sheet(s) with the non-toxic textile sheet(s). The garment may exclude all metals and toxic materials. The garment may be a foundation garment, for example a brassiere. In a brassiere the non-toxic elastomeric sheet(s) and the non-toxic textile sheet(s) form a front bust portion and a band, the front bust portion which includes at least one panel sized and dimensioned to retain a pair of breasts when the brassiere is worn, and the band which physically couples opposed laterally spaced apart ends of the front bust portion together when the brassiere is worn. The brassiere can have distinct cups, or may not have distinct cups, for instance a sports bra style. The garment can hold, or include, a prosthetic.

20 Claims, 13 Drawing Sheets

(56) References Cited

U.S. PATENT DOCUMENTS

| | | | | |
|---|---|---|---|---|
| 2,249,198 | A | 7/1941 | Carter | |
| 2,264,384 | A | 12/1941 | Kneibler | |
| 2,385,995 | A | 10/1945 | Kneibler | |
| 2,553,353 | A | 5/1951 | Binder et al. | |
| 2,602,928 | A | 7/1952 | Franklin | |
| 2,623,210 | A | 12/1952 | Franklin | |
| D170,721 | S | 10/1953 | Rosner | |
| 2,687,525 | A | 8/1954 | Rutledge | |
| 2,792,698 | A | 5/1957 | Hampp | |
| 3,083,710 | A | 4/1963 | Rauser | |
| 3,174,482 | A | 3/1965 | Parrott | |
| 3,220,410 | A | 11/1965 | Gerald | |
| 3,525,336 | A | 8/1970 | Wadman | |
| 3,590,823 | A | 7/1971 | Pope | |
| 4,280,229 | A | 7/1981 | Stein | |
| 4,642,818 | A | 2/1987 | Dehnert et al. | |
| 5,131,100 | A | 7/1992 | Atwater et al. | |
| 5,351,340 | A | 10/1994 | Aldridge | |
| 5,403,271 | A | 4/1995 | Saunders et al. | |
| 5,533,961 | A | 7/1996 | Iwata | |
| 5,536,246 | A | 7/1996 | Saunders | |
| 5,611,084 | A | 3/1997 | Garry et al. | |
| 5,611,722 | A | 3/1997 | Osborne | |
| 5,758,367 | A | 6/1998 | Torrent et al. | |
| 5,954,564 | A | 9/1999 | Ganz | |
| 6,061,832 | A | 5/2000 | Morrison | |
| 6,066,108 | A | 5/2000 | Lundberg | |
| 6,108,819 | A | 8/2000 | Debaene et al. | |
| 6,205,591 | B1 | 3/2001 | Wheeler et al. | |
| 6,367,086 | B1 | 4/2002 | Woodard | |
| 6,704,942 | B2 | 3/2004 | Lazarian | |
| 6,922,849 | B1 | 8/2005 | Fedrick | |
| 7,124,448 | B2 | 10/2006 | Davenport | |
| D552,328 | S | 10/2007 | Smith et al. | |
| 7,426,754 | B2 | 9/2008 | Chun et al. | |
| D627,133 | S | 11/2010 | Hendrickson | |
| D631,228 | S | 1/2011 | Winstanley | |
| 7,862,401 | B2 * | 1/2011 | Watrin | A41C 5/005 450/39 |
| 7,882,574 | B2 | 2/2011 | Arsenault et al. | |
| 7,900,276 | B2 | 3/2011 | Hendrickson et al. | |
| D644,412 | S | 9/2011 | Reuther | |
| D677,036 | S | 3/2013 | Adorna | |
| 8,990,970 | B2 | 3/2015 | Lee | |
| D728,898 | S | 5/2015 | Haeberle | |
| 9,044,051 | B1 | 6/2015 | Rydman et al. | |
| D742,621 | S | 11/2015 | Callahan | |
| 9,326,552 | B2 | 5/2016 | Hays et al. | |
| 9,433,250 | B2 | 9/2016 | Merchen | |
| 9,452,100 | B2 | 9/2016 | Bigelow | |
| 2005/0268379 | A1 | 12/2005 | MacGeorge | |
| 2007/0186325 | A1 | 8/2007 | Torrent et al. | |
| 2009/0098803 | A1 * | 4/2009 | Reinisch | A41C 3/0014 450/86 |
| 2009/0138064 | A1 | 5/2009 | Horn | |
| 2010/0101586 | A1 | 4/2010 | Frye | |
| 2013/0019370 | A1 | 1/2013 | Dweck et al. | |
| 2013/0084777 | A1 * | 4/2013 | Starr | A41C 3/0057 450/86 |
| 2013/0185900 | A1 | 7/2013 | Campbell | |
| 2014/0004771 | A1 | 1/2014 | Olumide | |
| 2014/0154949 | A1 | 6/2014 | Pagnon | |
| 2014/0170934 | A1 | 6/2014 | Palav | |
| 2015/0071978 | A1 | 3/2015 | Chang | |
| 2015/0257963 | A1 | 9/2015 | Prahm | |
| 2015/0351465 | A1 | 12/2015 | Duraku | |
| 2016/0044971 | A1 | 2/2016 | Randall et al. | |
| 2016/0198775 | A1 * | 7/2016 | Crompton | A41C 3/122 450/52 |
| 2017/0143047 | A1 | 5/2017 | Howard et al. | |

FOREIGN PATENT DOCUMENTS

| | | | |
|---|---|---|---|
| CN | 1741755 | A | 3/2006 |
| EP | 2548461 | B1 | 5/2016 |
| JP | 2004339683 | A | 12/2004 |
| WO | 9623920 | A1 | 8/1996 |
| WO | 2010017675 | A1 | 2/2010 |
| WO | 2015124812 | A1 | 8/2015 |
| WO | 2015173524 | A1 | 11/2015 |

OTHER PUBLICATIONS

Golden Girl Tummy Control High Waist Panty Shaper Underwear + 1 Fancy Ladies PU Leather Belt, retrieved from http://www.amazon.in/Golden-Tummy-Control-Shaper-Underwear/dp/B00ZHWWRN4 on Jun. 16, 2017, in 4 pages.

International Search Report and Written Opinion for International Application No. PCT/US2016/021534 dated Jun. 21, 2016 18 pages.

International Search Report and Written Opinion for International Application No. PCT/US2018/048496 dated Apr. 17, 2019 14 pages.

Lumbar Wear Men's Fly Front Brief, retrieved from http://www.painreliever.com/lumbar-wear-men-s-fly-front-brief-759514731-i.html on Jun. 16, 2017, in 3 pages.

Lumbar-sacral support for women, retrieved from http://www.spikenergy.co.uk/spikenergy/lumbar-sacral-support-for-women.html on Jun. 16, 2017, in 3 pages.

Mens Bodysculpt High Waist Trunks Shape Enhancer Lumbar Support Pants White M/L, retrieved from http://www.ebay.com/itm/MENS-BODYSCULPT-HIGH-WAIST-TRUNKS-SHAPE-ENHANCER-LUMBAR-SUPPORT-PANTS-WHITE-M-L-/171731377376 on Jun. 16, 2017, in 3 pages.

* cited by examiner

GARMENTS, FOR EXAMPLE BRASSIERES, EMPLOYING ELASTOMERS, FOR EXAMPLE SILICONE, AND METHODS OF MANUFACTURING SAME

TECHNICAL FIELD

The present disclosure generally relates to garments, for example, brassieres, and to method of manufacturing the same.

BACKGROUND

Description of the Related Art

A large variety of garments are worn by individuals, including outer garments and under garments. Garments may cover all or a portion of an upper body (e.g., torso), cover all or a portion of a lower body (e.g., hips and/or legs), or may cover all or a portion of an entire body.

Some garments provide support for the body or a portion thereof, and are commonly referred to as foundation garments. One ubiquitous type of foundation garment is a brassiere, commonly referred to as a "bra" in the United States. Other foundation garments include, but are not limited to: bodysuits, corsets, bustier, control panties, garter belts, girdles, body briefs, compression pants or shorts, control slips, and control camisoles or leotards.

BRIEF SUMMARY

Many garments employ materials that may irritate or may even be hazardous over time to the wearer. For example, various materials may slowly leach small amounts of man-made chemicals or other toxins into the skin of a wearer over time, or may include one or more materials (e.g., metals) that produce undesired affects in all humans or a subset of humans that are sensitive to certain substances.

In light of such, non-toxic, natural, and, or organic textile or fabrics may be advantageously employed in producing garments, particularly garments that come in contact or close proximity to the skin when worn. Such non-toxic, natural, and, or organic textiles or fabrics avoid the use or inclusion of synthetic chemicals, additives or treatments. In some instances, natural or organic material (e.g., bamboo) may be processed, yet produce a non-toxic bamboo fiber textile or fabric. The use of non-toxic, natural, and, or organic textiles or fabrics not only reduces direct skin exposure to synthetics and associated chemicals, but also reduces the possibility emitting toxics into the environment during manufacture of the garments or materials from which the garments are produced.

Non-toxic materials or fabrics, preferably organic, take a variety of forms, for example organic cotton, linen, silk, and bamboo fiber textiles. Support garments typically rely on an inclusion of an elastomer. One non-toxic elastomer is silicone, an inert synthetic material.

A brassiere may be summarized as including: at least one non-toxic elastomeric sheet, at least one non-toxic textile sheet, and a plurality of stitches that physically couple the at least one non-toxic elastomeric sheet with the at least one non-toxic textile sheet, the at least one non-toxic elastomeric sheet and the at least one non-toxic textile sheet which form a front bust portion and a band, the front bust portion which includes at least one panel sized and dimensioned to retain a pair of breasts when the brassiere is worn, and the band which physically couples opposed laterally spaced apart ends of the front bust portion together when the brassiere is worn.

The at least one non-toxic elastomeric sheet may form a multiple ply elastomeric sling, with a pair of concave portions that extend along a bottom edge of the front bust portion, and which concave portions of the multiple ply sling underlie and support respective breasts when the brassiere is worn. The at least one non-toxic elastomeric sheet may be a silicone sheet. The at least one non-toxic elastomeric sheet may be at least one compressed silicone sheet. The at least one compressed silicone sheet may form a multiple ply silicone sheet frame that includes multiple plies of silicone sheet. The at least one compressed silicone sheet may form a multiple ply silicone sheet frame that includes multiple, e.g., overlapping, plies of silicone sheet without any underwire. The at least one compressed silicone sheet may include a first compressed silicone sheet and a second silicone sheet, the first compressed silicone sheet which forms a frame of multiple plies of silicone sheet without any underwire, and the second compressed silicone sheet which extends upward to a pair of spaced apart apexes. The at least one compressed silicone sheet may include a first compressed silicone sheet, a second compressed silicone sheet, and a third compressed silicone sheet, the first compressed silicone sheet which forms a frame of multiple plies of silicone sheet without any underwire, the second compressed silicone sheet which extends upward to a first apex, and the third compressed silicone sheet which extends upward to a second apex, the second apex spaced laterally apart from the first apex at least when the brassiere is worn. The first, the second and the third compressed silicone sheets may each be seamless. The brassiere may further include: at least a first strap, the first strap which extends from the first apex to the band. The at least one compressed silicone sheet may include a first compressed silicone sheet, a second compressed silicone sheet, a third compressed silicone sheet, and a fourth compressed silicone sheet, the first compressed silicone sheet which forms a multiple ply frame of multiple plies of silicone sheet without any underwire, the second compressed silicone sheet which extends upward to a first apex to at least partially cover a first breast when worn, and the third compressed silicone sheet which extends upward to a second apex to at least partially cover a second breast when worn, the second apex spaced laterally apart from the first apex at least when the brassiere is worn, and the fourth compressed silicone sheet which forms the band. The at least one non-toxic textile sheet may include a self sheet and a lining sheet, the at least one silicone sheet is sandwiched between the self sheet and the lining sheet. The at least one non-toxic textile sheet may be a natural material, and, or an organic material. The at least one non-toxic textile sheet may comprise any one or more of silk, linen, organic cotton, and bamboo. The front bust portion may include a first cup and a second cup, the first and the second cups being non-molded cups. The front bust portion may include a bridge that physically couples the first and the second cups together. The brassiere may further include: at least one selectively releasable fastener positioned in the front bust portion between the breasts. The brassiere may further include: at least one selectively releasable fastener positioned in the band. The front bust portion and the band may provide a continuous piece without a closure. The entire brassiere may be devoid of any metal and devoid of any toxic materials, and may further include at least one breast prosthetic.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with garments, including fasters and decorative features, have not been shown or described in detail to avoid unnecessarily obscuring descriptions of the embodiments.

Unless the context requires otherwise, throughout the specification and claims which follow, the word "comprise" and variations thereof, such as "comprises" and "comprising," are to be construed in an open, inclusive sense, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

FIGS. 1A-1G show a garment in the form of a brassiere 100 in a first style, e.g., a sports bra, according to at least one according to at least one illustrated embodiment.

Figure 1A:
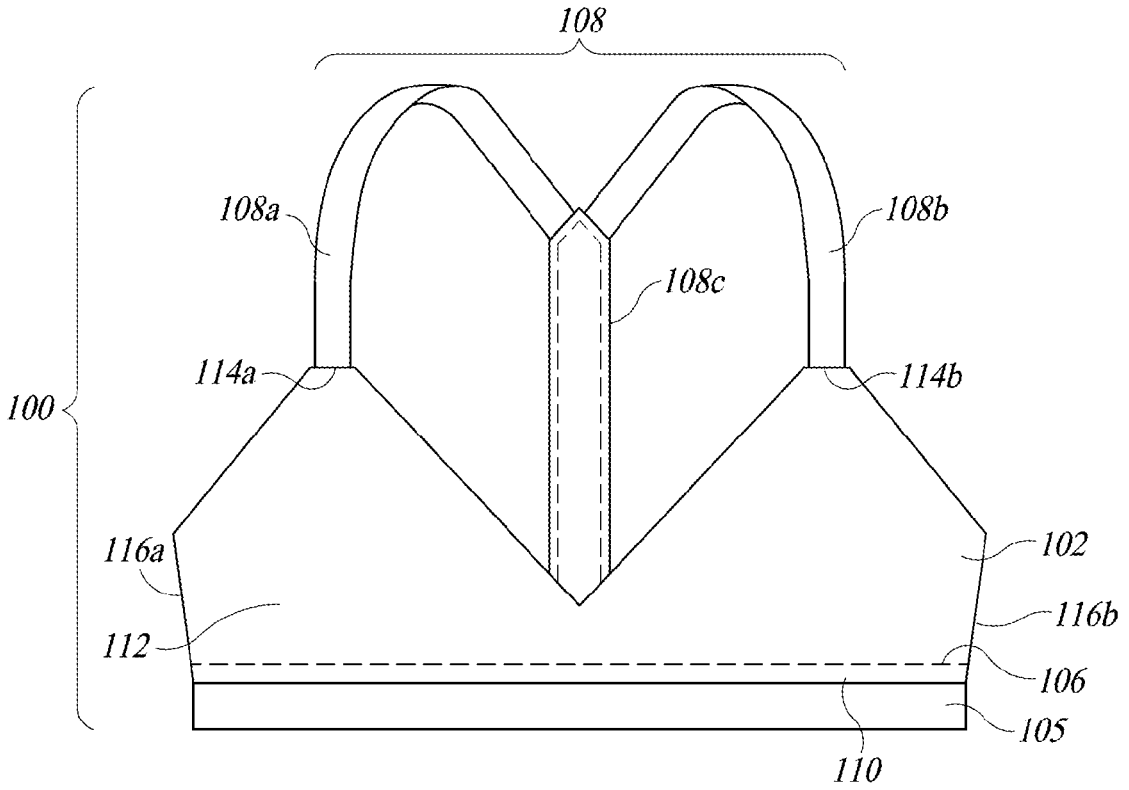
FIG. 1A is a front elevational view of a garment in the form of a brassiere in a first style, having a front bust portion, a band, stitching, and optional straps, according to at least one illustrated embodiment.
Figure 1B:
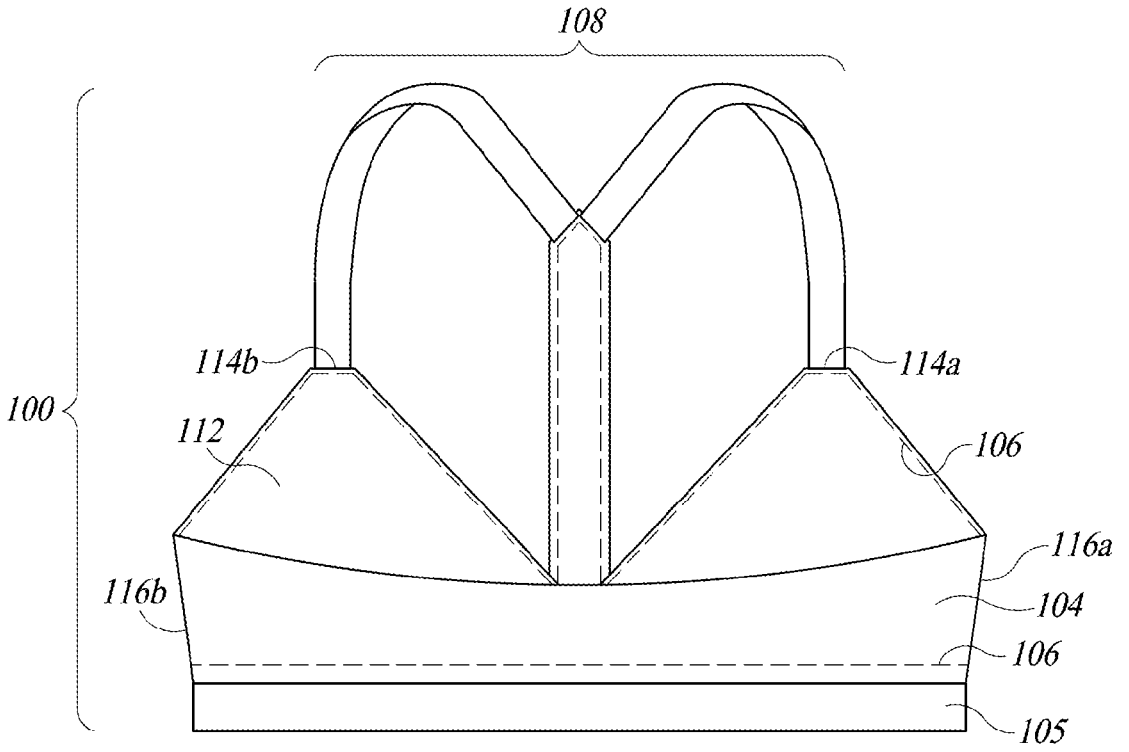
FIG. 1B is a rear elevational view of the brassiere of FIG. 1A.

Referring in particular to FIGS. 1A and 1B, the brassiere 100 includes a front bust portion 102, wings 104, and under band 105, stitching 106, and optional straps 108.

The front bust portion 102 includes a frame 110 and at least one panel 112 that is sized and dimensioned to retain a pair of breasts when the brassiere is worn. The at least one panel 112 extends generally upward from the frame 110 and, or band 105, and may terminate in a pair of apexes 114*a*, 114*b* (collectively 114). The apexes 114 may be laterally spaced from one another across the front bust portion 102.

The wings 104 physically couple opposed laterally spaced apart ends 116*a*, 116*b* (collectively 116) of the front bust portion 102 together when the brassiere 100 is worn. The wings 104 along with the band 105 may form a continuous, closed loop or closed band, with no opening and no closure or fasteners. Alternative, some implementations may include an opening and selectively releasable fasteners, for instance at the back or front, as illustrated and discussed with reference to FIGS. 3A and 3B. A least a portion of the wings 104 extend along a wear's sides, generally under the arms, when worn.

The straps 108 typically extend from the apexes 114 of the front bust portion 102 to the wings 104, proximate a back or rear of the brassiere 100. In the implementation illustrated in FIGS. 1A and 1B, the strap 108 is a Y-shaped strap, with two portions 108*a*, 108*b*, each extending from a respective apex, and a portion 108*c* terminating at a center back portion the band or wings 104.

Figure 1C:
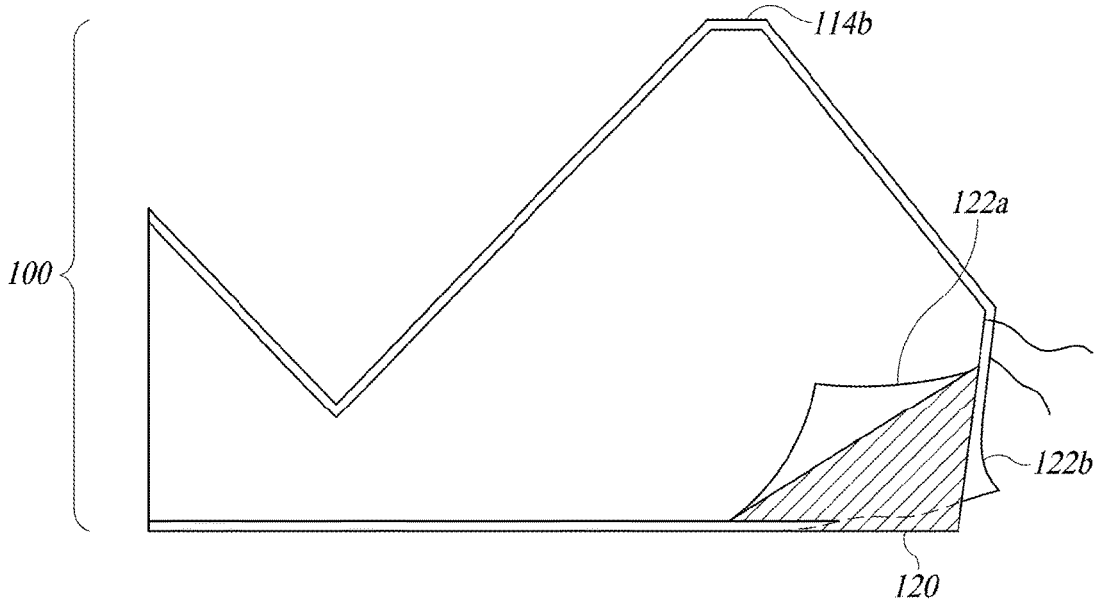
FIG. 1C is a partial front elevational view of the front bust portion of the brassier of FIG. 1A, with a number of layers separated to better illustrate a construction thereof, including an elastomer layer sandwiched between a pair of textile or fabric layers.

With reference in particular to FIG. 1C, the brassiere 100 may be made of two or more layers, including at least one inert, non-toxic, biocompatible elastomer layer 120 and one or more non-toxic, natural (e.g., organic) textile or fabric layers 122*a*, 122*b* (collectively 122).

Figure 1D:
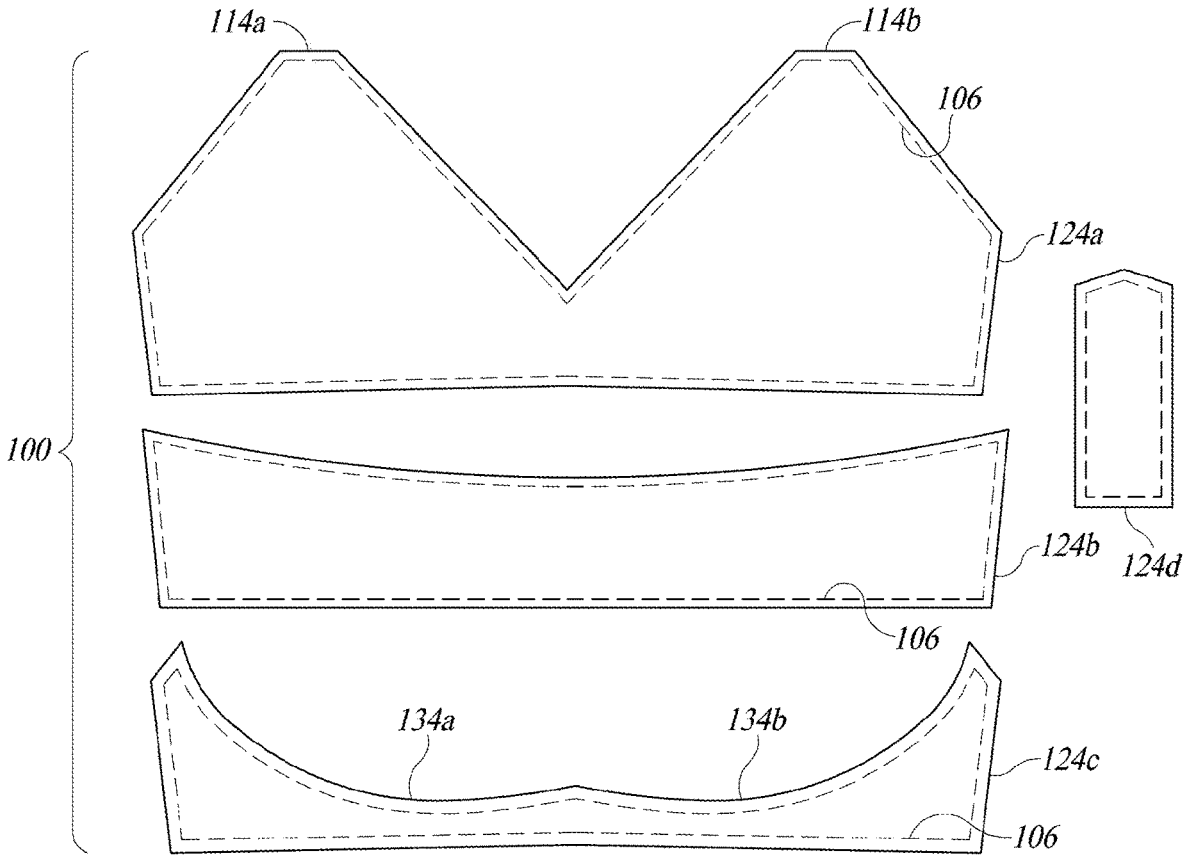
FIG. 1D is a pattern for an elastomer seamless panel or sheet of the front bust portion, and an elastomer seamless panel or sheet of the wing portion, and an elastomer seamless panel or sheet of an under band portion of the brassiere of FIG. 1A, which forms one layer of the front bust portion and one layer of the band, according to at least one illustrated embodiment.

The inert, non-toxic, biocompatible elastomer layer 120 may include one or more inert and, or non-toxic, and, or biocompatible elastomer panels or sheets, for example silicone (e.g., medical grade silicone, food grade silicone, silicone, rubber, polydimethylsiloxane) panels or sheets, and more advantageously compressed silicone panels or sheets 124*a*, 124*b*, 124*c*, 124*d* (FIG. 1D). Elastomers are typically polymers which are flexible (i.e., having a low rigidity on the order of several Mega-pascals) and are elastic or resilient (i.e., returns to original shape or configuration or size after removal of a deforming force that was less than a force at which rupture occurs). Elastomers may optionally be highly deformable (i.e., able to withstand high deformation forces without rupturing, with an elongation of about 200% at point of rupture). As used herein, biocompatible means biocompatible with respect to the intended use, in the case of garments meaning biocompatible with respect to long term (e.g., decades, life time) contact with skin bodily tissue. Notably, the silicone panels or sheets or compressed silicone panels or sheets 124*a*, 124*b*, 124*c* advantageously are silicone substrates or sheets, in contrast to textiles or fabrics that are coated with silicone or in which silicone has been infused or injected or otherwise impregnated.

Figure 1E:
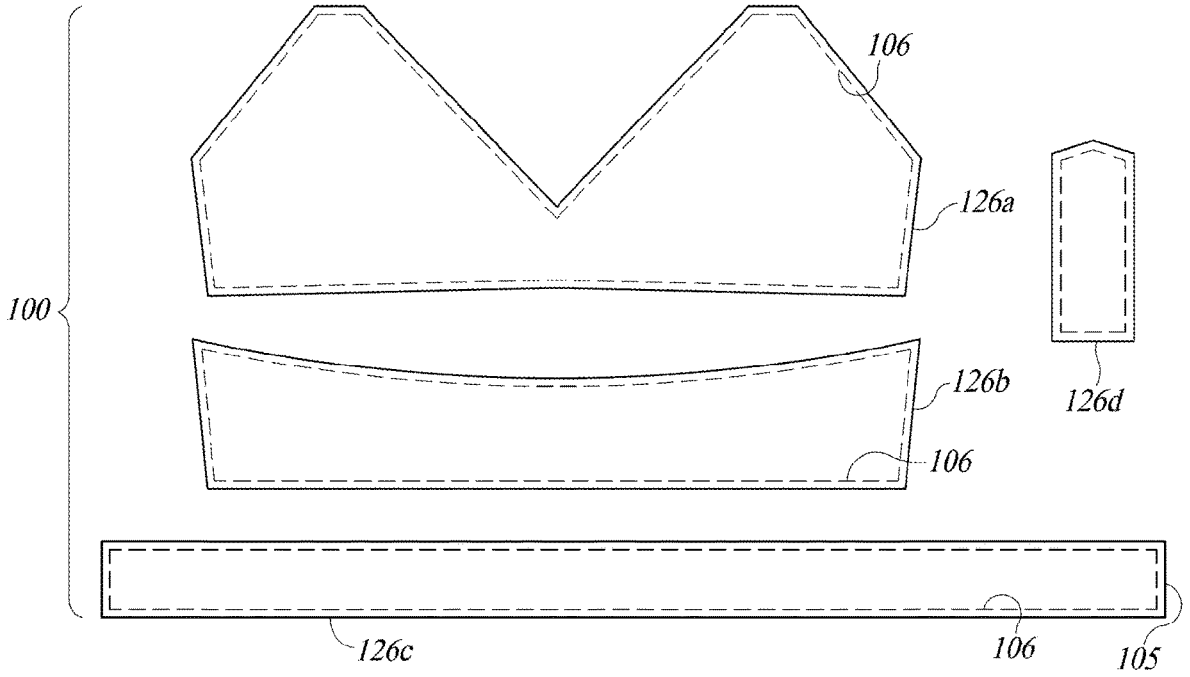
FIG. 1E is a pattern for an outermost seamless textile or fabric panel or sheet of the front bust portion, an outermost seamless textile or fabric panel or sheet of the wing portion, and an outermost seamless textile or fabric panel or sheet of an under band portion of the brassiere of FIG. 1A, which forms one layer of the front bust portion and one layer of the band, according to at least one illustrated embodiment.
Figure 1F:
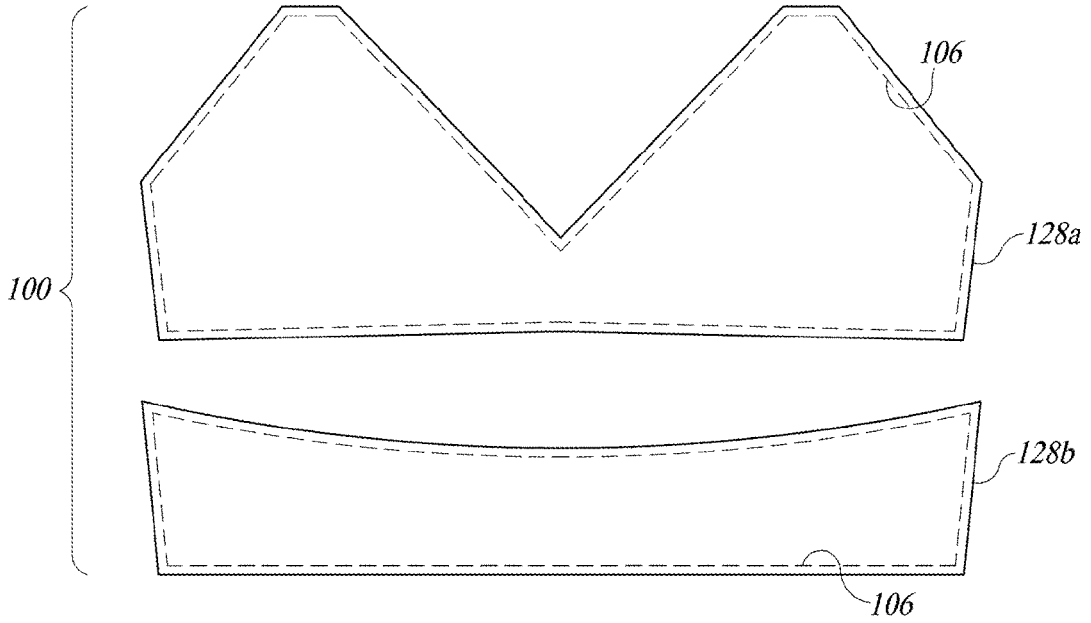
FIG. 1F is a pattern for an innermost seamless textile or fabric panel or sheet of the front bust portion and an innermost seamless textile or fabric panel or sheet of the wing portion of the brassiere of FIG. 1A, which forms one layer of the front bust portion and one layer of the wings, according to at least one illustrated embodiment.

The natural textile or fabric layers 122*a*, 122*b* include one or more natural, non-toxic, textile or fabric panels or sheets 126*a*, 126*b*, 126*c*, 128*a*, 128*b*(FIGS. 1E, 1F). In particular, a first natural, non-toxic, textile or fabric panels or sheets 126*a* may form an outermost layer of the front bust portion 102, while a second natural, non-toxic, textile or fabric panels or sheets 126*b* may form an outermost layer of the wing portion 104. In particular, a third natural, non-toxic, textile or fabric panels or sheets 128*a* may form an innermost layer of the front bust portion 102, while a fourth natural, non-toxic, textile or fabric panels or sheets 128*b* may form an outermost layer of the band or wing portion 104. A fifth natural, non-toxic, textile or fabric panels or sheets 126*c* may form the band 105. The natural textile or fabric panels or sheets 126*a*, 126*b*, 126*c*, 128*a*, 128*b* may for example include one or more of silk, linen, organic cotton, and, or bamboo fiber panels or sheets 122. Thus, a garment may, for example, include a self textile sheet, a lining textile sheet, and at least one elastomer (e.g., silicone, compressed silicone) sheet sandwiched between the self textile sheet and the lining textile sheet.

FIG. 1D shows an inert, non-toxic, elastomer seamless panel or sheet, e.g., compressed silicone panel or sheet, 124*a* of the front bust portion 102, an elastomer seamless panel or sheet, e.g., compressed silicone panel or sheet, 124*b* of the band or wings portion 104 of the brassiere 100 of FIG. 1A, and an elastomer seamless panel or sheet, e.g., compressed silicone panel or sheet, 124*c* of a frame or sling 130 of the brassiere 100 of FIG. 1A, which form at least one layer 120 (FIG. 1C) of the front bust portion 102 and at least one layer of the wing portion 104, and at least one layer of the frame or sling 130, along with stitching 106, according to at least one illustrated embodiment. Optional compressed silicone panel or sheet, 124*d* may form a portion of a back strap.

FIG. 1E shows an outermost seamless natural textile or fabric panel or sheet 126*a* of the front bust portion 102, an outermost seamless natural textile or fabric panel or sheet 126*b* of the wings portion 104 of the brassiere 100 of FIG. 1A, and an outermost seamless natural textile or fabric panel or sheet 126*c* of the band 105 of the brassiere 100 of FIG. 1A which forms one layer 122*a* (FIG. 1C) of the front bust portion 102 and one layer of the wings portion 104, and the band 105, along with stitching 106, according to at least one illustrated embodiment. Optional seamless natural textile or fabric panel or sheet, 126*d* may form a portion of a back strap. The outermost layers are denominated as the self of the brassiere 100.

FIG. 1F shows an innermost seamless natural textile or fabric panel or sheet of the front bust portion 128*a* and an innermost seamless natural textile or fabric panel or sheet 128*b* of the wings portion 104 of the brassiere 100 of FIG. 1A, which forms one layer 122*b* of the front bust portion 102 and one layer of the wings portion 104, along with stitching 106, according to at least one illustrated embodiment. The innermost layers are denominated as the lining of the brassiere 100.

While FIG. 1D shows separate respective inert, non-toxic, elastomer seamless panel or sheet for the front bust portion 102 and the wings portion 104, in some implementations a single inert, non-toxic, elastomer seamless panel or sheet may form both the front bust portion 102 and the wing portion 104, single inert, non-toxic, elastomer seamless panel or sheet having two opposed ends which may be permanently attached together (e.g., sewn) during manufacture, or where a closure may be located for selective fastening and releasing during use, after manufacture. Similarly, the while FIGS. 1E and 1F shows separate respective natural textile or fabric panels or sheets for the inner and outer layers of the front bust portion 102 and the wings portion 104, in some implementations a single natural textile or fabric panel or sheet may form the inner layer of both the front bust portion 102 and the wings portion 104, and, or a single natural textile or fabric panel or sheet may form the outer layer of both the front bust portion 102 and the wings portion 104.

With continuing reference to FIGS. 1D-1F, the two or more layers, including at least one inert elastomer layer 120 and one or more natural textile or fabric layers 122*a*, 122*b* of the brassiere 100 may be attached or secured to one another via a plurality of stitches 106 via one or more strands of threads, for example a natural, organic thread. The plurality of stitches 106 physically couple the at least one inert or non-toxic elastomeric sheet or panel 124*a*, 124*b* (FIG. 1D) with the at least one natural textile or fabric sheets or panels 126*a*, 126*b* (FIG. 1E), 128*a*, 128*b* (FIG. 1F) to form the front bust portion 102 and the wings 104, and the band 105.

Figure 1G:
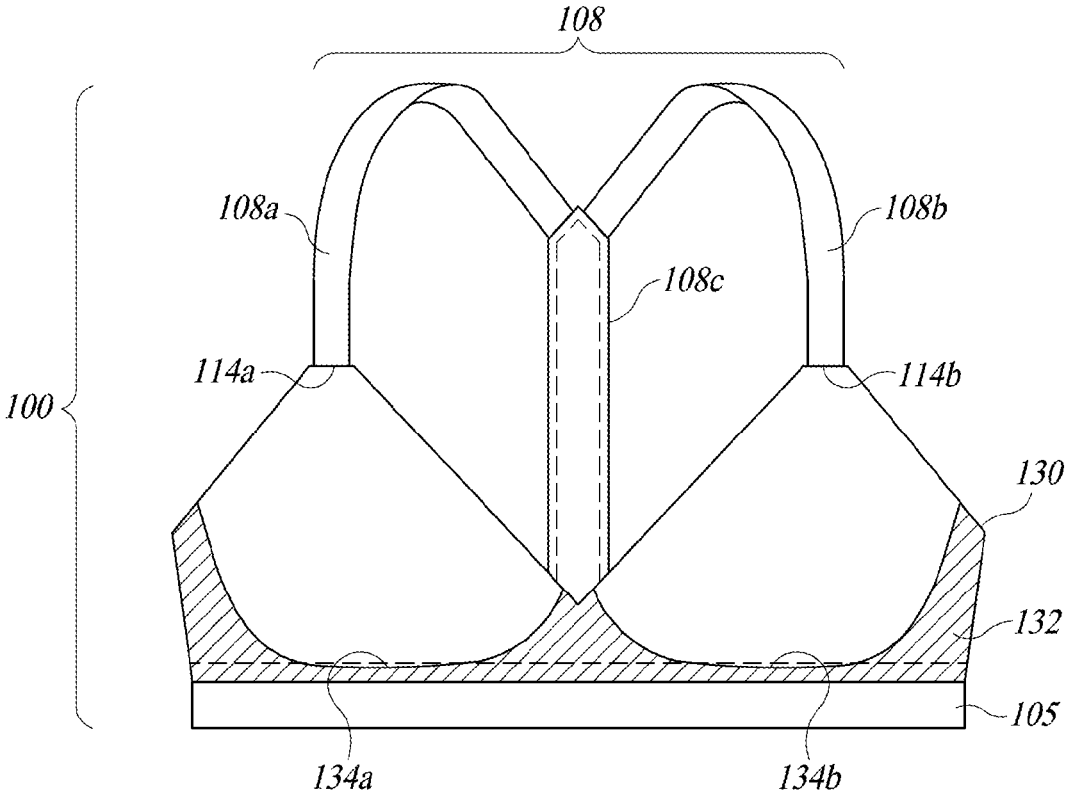
FIG. 1G is a front elevational view of the brassiere of FIG. 1A, according to at least one illustrated embodiment, in particular illustrating a frame or sling comprised of a multi-ply elastomer, for instance a multi-ply silicone sheet, and which forms a portion of the front bust portion of the brassiere.

FIG. 1G shows the brassiere of FIG. 1A, in particular illustrating a frame or sling 130 comprised of a multi-ply inert elastomer, e.g., a multi-ply silicone or multi-ply compressed silicone panel or sheet 132, and which forms a portion of the front bust portion 102 of the brassiere 100. The multi-ply compressed silicone panel or sheet 132 includes multiple layers (i.e., two, three or more) of silicone or compressed silicone material, overlying or in registration with one another. For example a portion of the inert, non-toxic, elastomer seamless panel or sheet, e.g., compressed silicone panel or sheet, 124*a* may overlap the inert, non-toxic elastomer seamless panel or sheet, e.g., compressed silicone panel or sheet, 124*c* to each form a respective layer of the multiple ply frame or sling 130. Such may advantageously enhance the ability of the frame or sling 130 to provide support to the body or portion thereof. In particular, the at least one compressed silicone sheet or panel may advantageously form a multiple silicone sheet frame or sling 130 that includes multiple plies ply (e.g., two or more overlapping plies) of silicone sheet or panels 132. Such can advantageously provide support of the breasts without any underwire. For example, a first compressed silicone sheet and a second compressed silicone sheet may form a frame or a sling 130 of multiple plies of silicone sheet without any underwire. The frame or sling 130 may include a pair of concave portions 134*a*, 134*b* (collectively 134) that extend along a bottom edge of the front bust portion, and which concave portions 134 of the multi-ply frame or sling 130 underlie and support respective breasts when the brassiere 100 is worn. The multi-ply frame or sling 130 may extends upward to a pair of spaced apart apexes 114*a*, 114*b*.

Figure 1H:
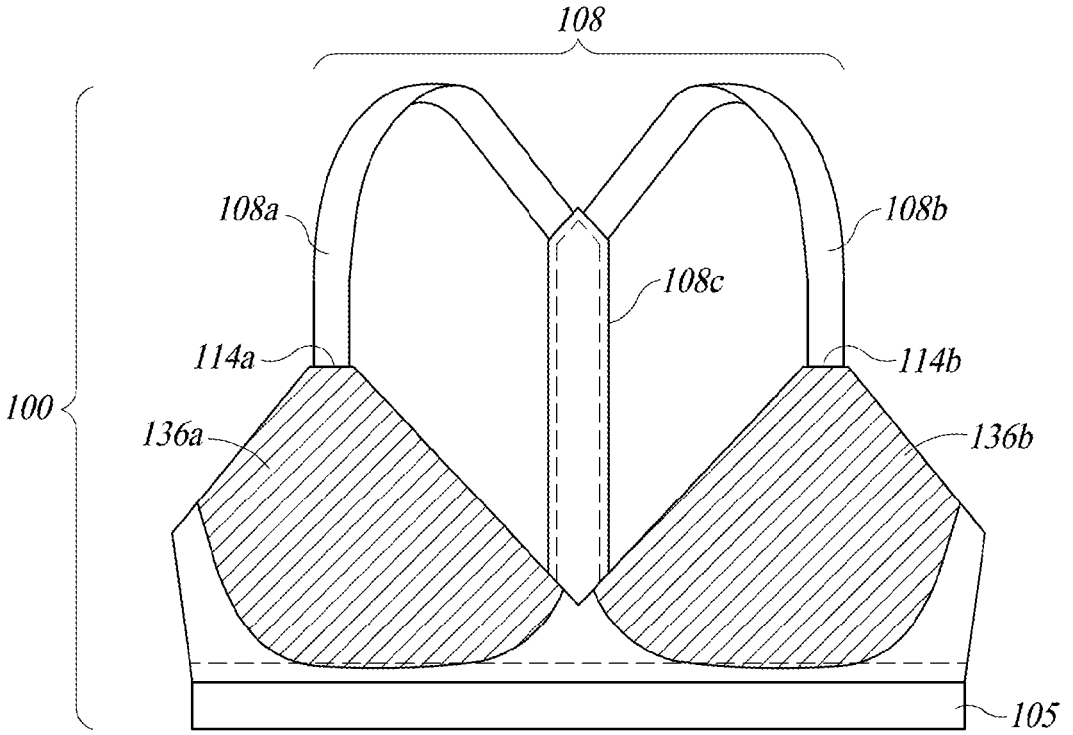
FIG. 1H is a front elevational view of the brassiere of FIG. 1A, in particular illustrating a pair of seamless elastomer sheets, for instance silicone sheets, that extend upward from the frame or sling, terminating in a pair of lateral spaced apexes.

FIG. 1H shows the brassiere 100 of FIG. 1A, in particular illustrating a pair of seamless inert elastomer sheets or panels, for instance silicone or compressed silicon sheets or panels 136*a*, 136*b*, that extend upward from the frame or sling 130, terminating in a pair of lateral spaced apexes 114*a*, 114*b*. The silicone or compressed silicon sheets or panels 136*a*, 136*b* advantageously cover the major portion of respective breasts when the brassiere 100 is worn, for example rendering the nipples and areola undiscernible or barely discernable. In some implementations, the silicone or compressed silicon sheets or panels 136*a*, 136*b* may be single ply, while in other implementations the silicone or compressed silicon sheets or panels 136*a*, 136*b* can be multi-ply.

Figure 1I:
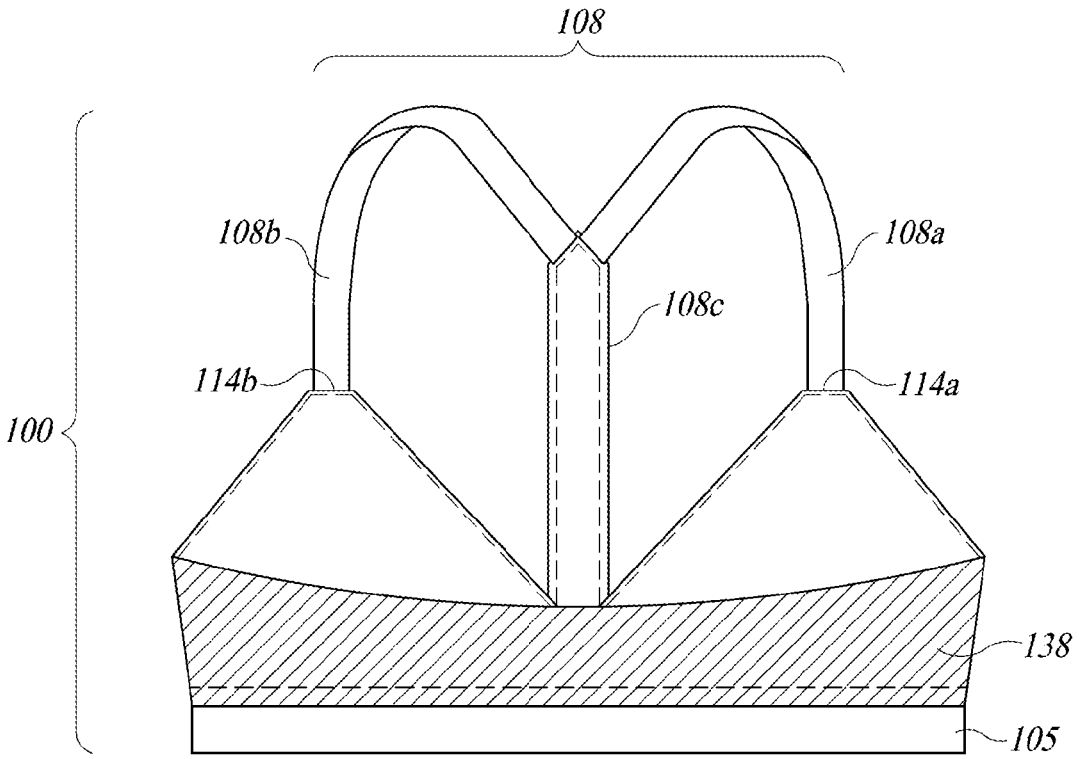
FIG. 1I is a rear elevational view of the brassiere of FIG. 1A, in particular illustrating an elastomer sheet, for instance silicone sheet, that forms a portion of the wings.

FIG. 1I shows the brassiere 100 of FIG. 1A, in particular illustrating an elastomer sheet, for instance silicone or compressed silicon sheet or panel 138, that forms a portion of the wings 104. The silicone or compressed silicon sheet or panel 138 advantageously flattens out flesh around the sides of the upper torso, e.g., under the arms, when the brassiere 100 is worn. In some implementations, the silicone or compressed silicon sheet or panel 138 may be single ply, while in other implementations the silicone or compressed silicon sheet or panel 138 can be multi-ply.

As previously noted, the least one inert, non-toxic elastomeric sheet may advantageously take the form of one or more silicone panels or sheets, for example at least one compressed silicone panel or sheet, although other inert or non-toxic elastomeric materials can be employed.

With reference to FIGS. 1G and 1I, in some implementations, at least the front bust portion 102 of the brassiere 100 may include a first compressed silicone sheet or panel 132, a second compressed silicone sheet or panel 136*a*, and a third compressed silicone sheet or panel 136*b*. The first compressed silicone sheet or panel 132 may form the frame or sling 132 of multiple plies of silicone sheet or compressed silicone sheet, advantageously without any underwire. The second compressed silicone sheet or panel 136*a* may extend upward from the frame or sling 130 to a first apex 114*a*, covering one breast when worn. The third compressed silicone sheet or panel 136*b* may extend upward from the frame or sling 134 to a second apex 114*b*, covering the other breast when worn. The second apex 114*b* is spaced laterally apart from the first apex 114*a* at least when the brassiere 100 is worn. The second and third compressed silicone sheets 136*a*, 136*b* may each be seamless, to provide an aesthetically pleasing effect. A fourth compressed silicone sheet 138 may form the wings 104. Inclusion of an elastomer layer in at least a portion of the frame, wings 104 or band 105 that extends along the sides, advantageously retains tissue that might otherwise bulge outward, for example from the portion of the torso that underlies the arms.

The entire brassiere 100 may advantageously be devoid of any metal and devoid of any toxic materials.

While not illustrated, in some implementations, the brassiere 100 may further include one or more breast prosthetics, preferably breast prosthetics of inert or non-toxic materials. The breast prosthetics may be inserted between the chest and the front bust portion of the brassiere 100 after the brassiere 100 is put on, or the brassiere 100 may alternative include one or more pockets sewn therein in which the breast prosthetics may be removably placed or permanently sewn into place.

FIGS. 2A-2F show a brassiere 200, according to at least one according to at least one illustrated embodiment. The brassiere 200 is similar in many respects to the brassiere 100 of FIGS. 1A-1I. Similar or even identical features are identified in FIGS. 2A-2D by the same references numbers as used in FIGS. 1A-1I. In the interest of conciseness, only some significant differences between the implementations are discussed below.

The brassiere 200 has a front bust portion 102, wing portion 104, band 105, stitching 106, and straps 218*a*, 218*b*.

In contrast to the brassiere 100, the brassiere 200 includes distinct first and second cups 240*a*, 240*b* (collectively 240) in the front bust portion 102. The first and the second cups 240*a*, 240*b* are typically non-molded cups, although some implementations can employ molded cups. The front bust portion 102 includes a bridge 242 that physically couples the first and the second cups 240*a*, 240*b* together at the front of the brassiere 200.

Figure 2A:
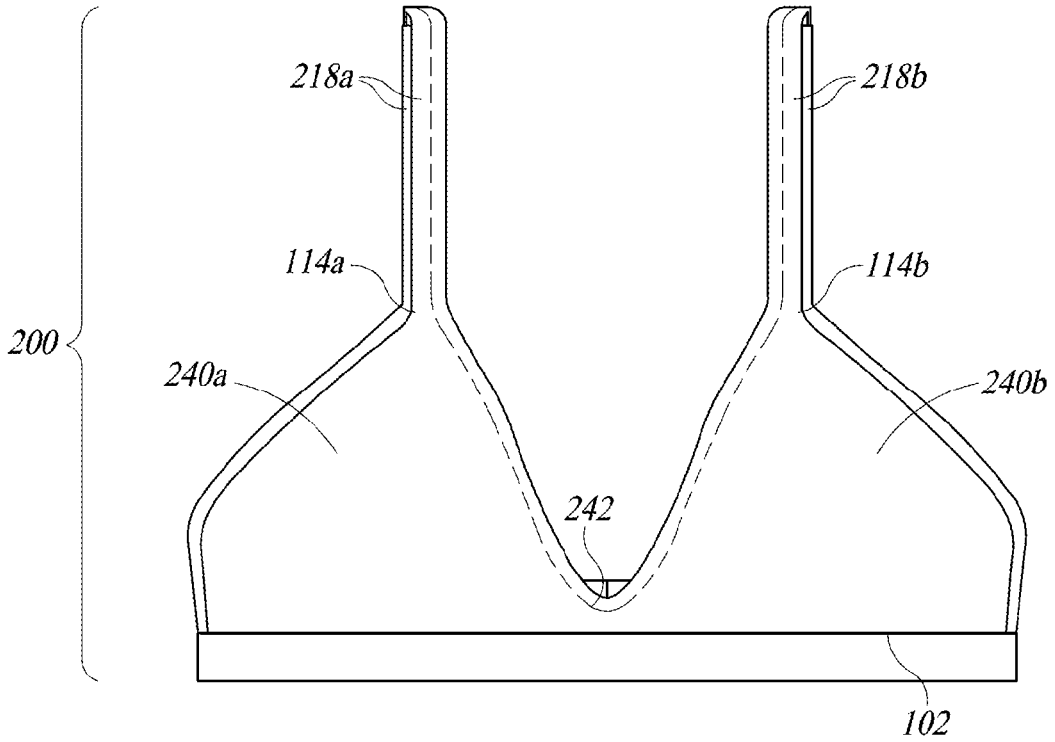
FIG. 2A is a front elevational view of a garment in the form of a brassiere in a second style, having a front bust portion, wings, under band, stitching, and optional straps, according to at least one illustrated embodiment.
Figure 2B:
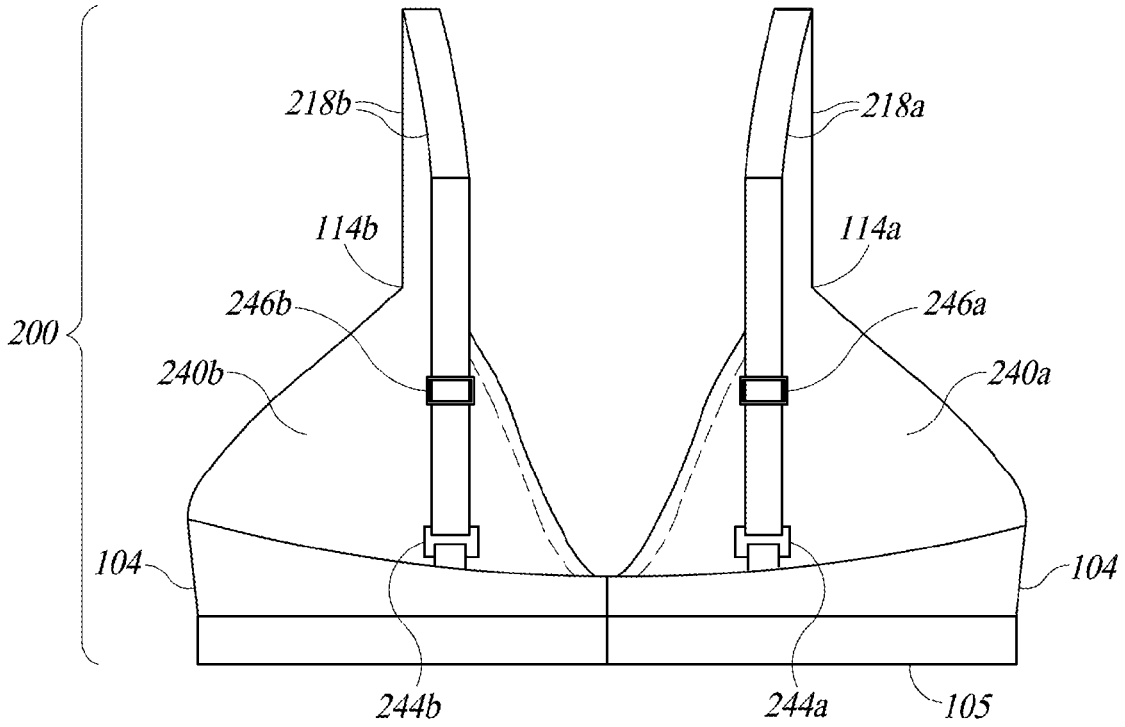
FIG. 2B is a rear elevational view of the brassiere of FIG. 2A.

With particular reference to FIG. 2B, the brassiere 100 may optionally include one or more straps, for example a first strap 218*a* which extends from the first apex 114*a* to the wing 104 at the back and a second strap 218*b* which extends from the second apex 114*a* to the wing 104 at the back. The straps 218*a*, 218*b* may be attached via one or more fasteners or rings 244*a*, 244*b* (collectively 244). The straps 218*a*, 218*b* may include one or more sliders 246*a*, 246*b*, that slide to adjustment the amount of slack in the straps 218*a*, 218*b*. The fasteners or rings 244 and sliders 246 are preferably made of an inert, non-toxic material, for example wood or bamboo.

Figure 2C:
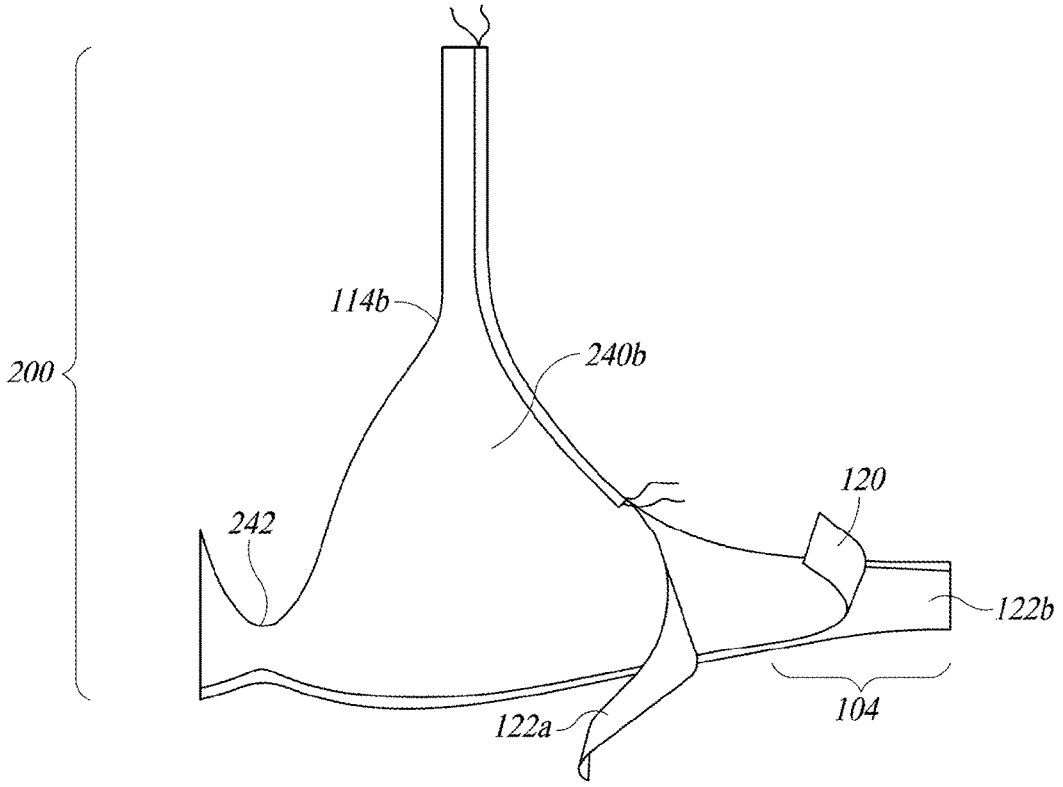
FIG. 2C is a partial front elevational view of the brassier of FIG. 2A with a number of layers separated to better illustrate a construction thereof, including an elastomer layer sandwiched between a pair of textile or fabric layers.

With reference to FIG. 2C, the brassiere 200 may be made of two or more layers, including at least one inert, non-toxic, elastomer layer 120 and one or more natural textile or fabric layers 122*a*, 122*b* (collectively 122). The inert, non-toxic, elastomer layer 120 may include one or more inert and, or non-toxic elastomer panels or sheets, for example silicone panels or sheets, and more advantageously compressed silicone panel or sheet 124 (FIG. 1D). The silicone panel or sheet or compressed silicone panel or sheet 124 is a silicone substrate or sheet, in contrast to textiles or fabrics that are coated with silicone or in which silicone has been infused or injected. The natural textile or fabric layers 122*a*, 122*b* include one or more natural, non-toxic, textile or fabric panels or sheets 126*a*, 126*b*, 128 (FIGS. 1E, 1F). In particular, a first natural, non-toxic, textile or fabric panels or sheets 126*a* may form an outermost layer of the front bust portion 102 and wings 104, while a second natural, non-toxic, textile or fabric panels or sheets 126*b* may form an outermost layer of the under band 105. In particular, a third natural, non-toxic, textile or fabric panels or sheets 128 may form an innermost layer of the front bust portion 102 and wing portion 104. The natural textile or fabric panels or sheets 126*a*, 126*b*, 128*a* (FIGS. 1E, 1F) may for example include one or more of silk, linen, organic cotton, wool, Merino wool, cellulose fibers, and, or bamboo fiber panels or sheets 122. Other materials which may be suitable for one or more components of the garment may include synthetic fibers, polyesters, nylons, and any polymer made from natural pant and/or animal material.

Figure 2D:
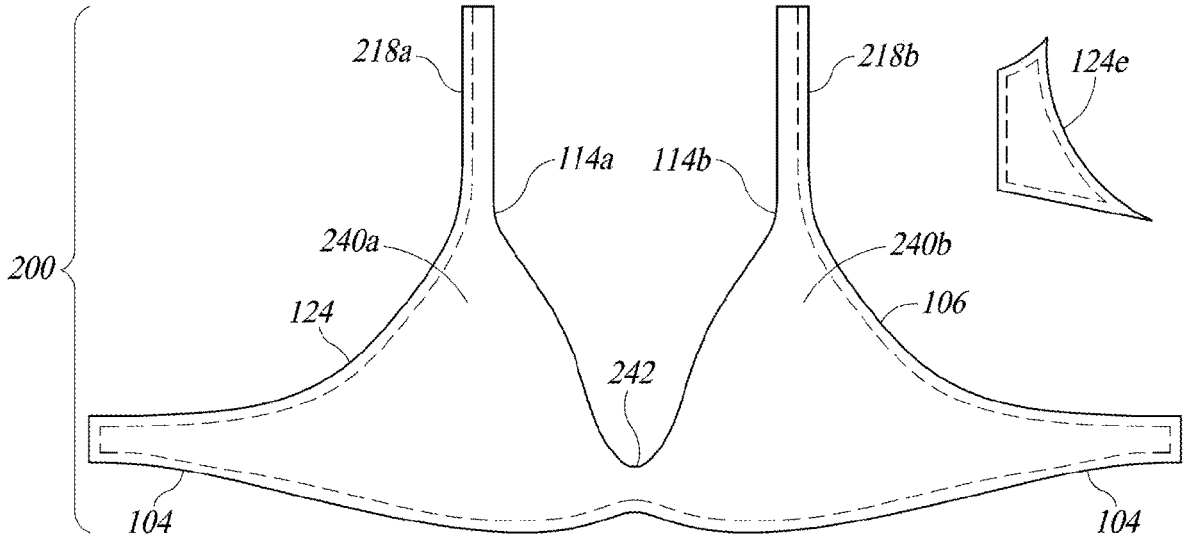
FIG. 2D is a pattern for an elastomer seamless panel or sheet of the front bust portion and wing portion of the brassiere of FIG. 2A, which forms one layer of the front bust portion and one layer of the wings, according to at least one illustrated embodiment.
Figure 2E:
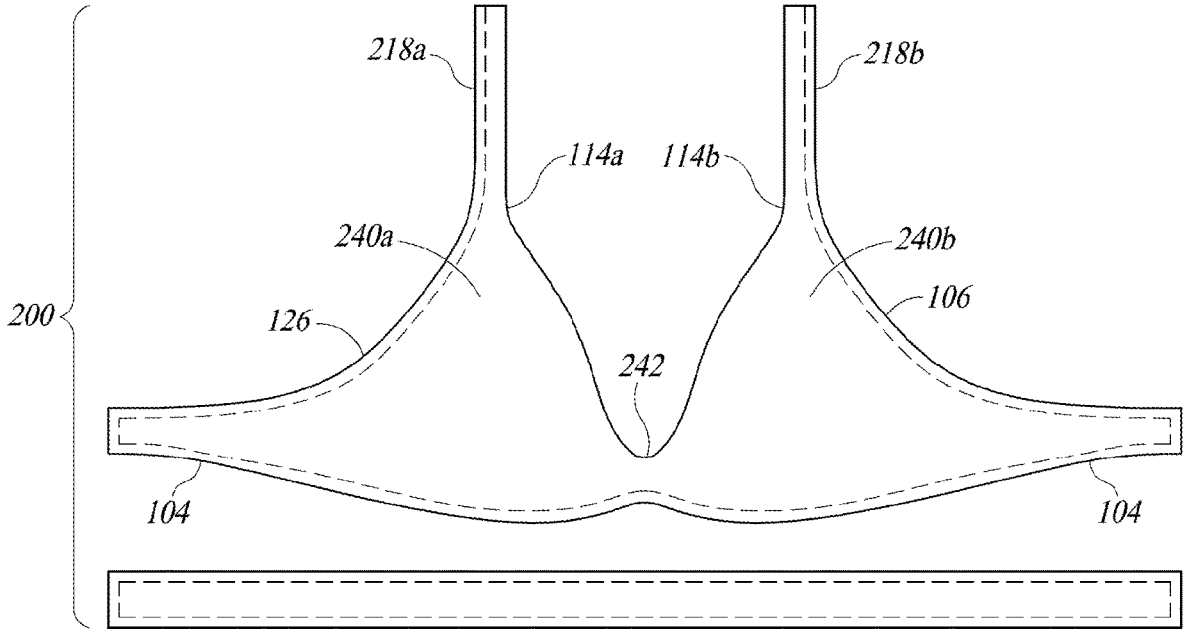
FIG. 2E is a pattern for an outermost seamless textile or fabric panel or sheet of the front bust portion and wing portion, and an outermost seamless textile or fabric panel or sheet of an under band portion of the brassiere of FIG. 2A, which forms one layer of the front bust portion and one layer of the under band, according to at least one illustrated embodiment.
Figure 2F:
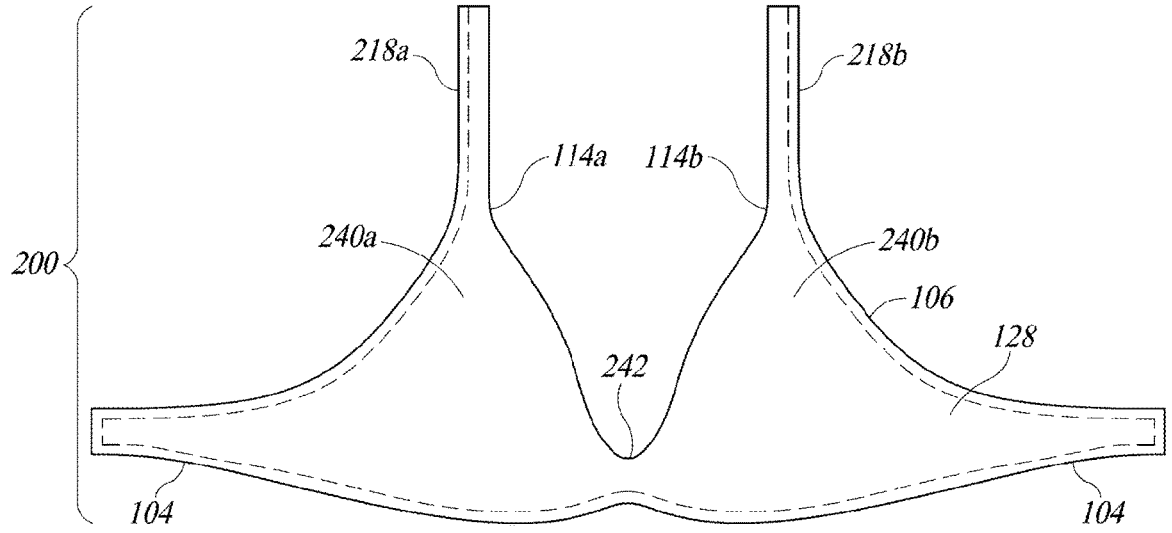
FIG. 2F is a pattern for an innermost seamless textile or fabric panel or sheet of the front bust portion and wing portion of the brassiere of FIG. 2A, which forms one layer of the front bust portion and one layer of the wings, according to at least one illustrated embodiment.

With reference to FIG. 2D, the silicone panel or sheet or compressed silicone panel or sheet 124 that form the at least one inert elastomer layer 120 may be attached or secured to the one or more natural textile or fabric layers 122*a*, 122*b* of the brassiere 200 may via a plurality of stitches 106 via one or more strands of threads, for example a natural, organic thread. The plurality of stitches 106 physically couple the at least one inert or non-toxic elastomeric sheet or panel 124 (FIG. 1D) with the at least one natural textile or fabric sheets or panels 126*a*, 126*b* (FIG. 1E), 128 (FIG. 1F) to form the front bust portion 102, the wings 104 and, or the band 105. A silicone panel or sheet or compressed silicone panel or sheet 124*e* may form a portion of a frame of the brassiere 200.

Figure 3A:
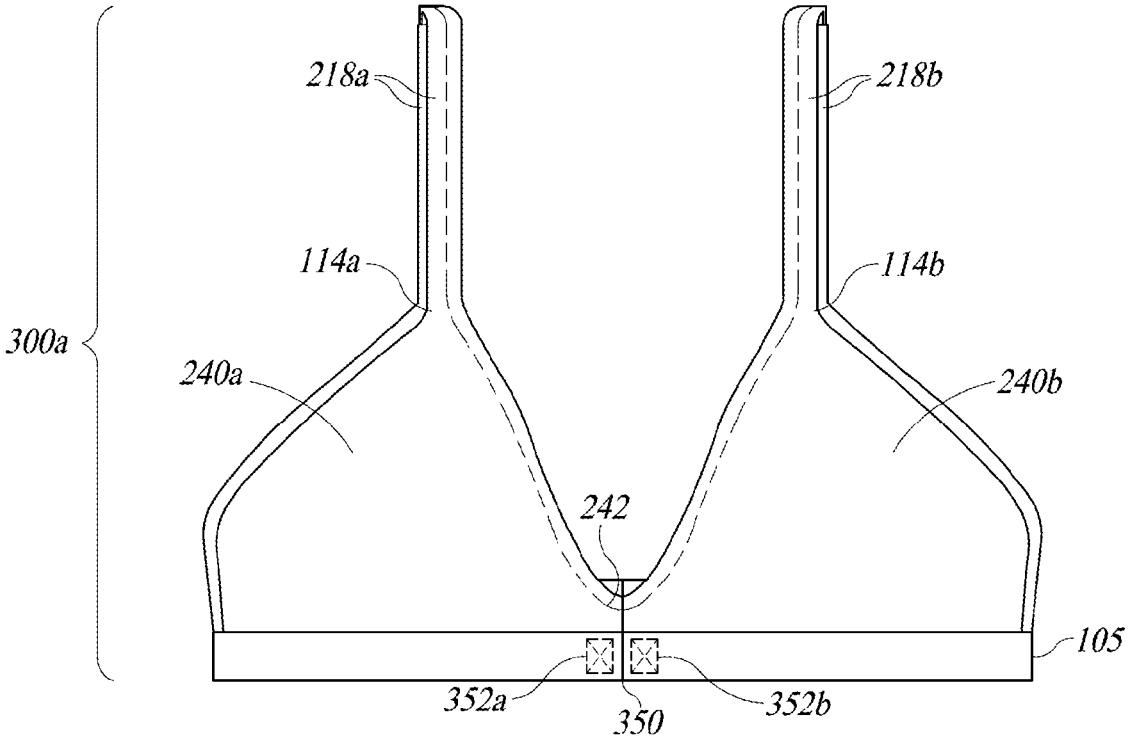
FIG. 3A is a front elevational view of a garment in the form of a brassiere having a front opening or closure and associated fasteners, according to at least one illustrated embodiment.

FIG. 3A show a brassiere 300*a*, according to at least one illustrated embodiment. The brassiere 300*a* is similar in many respects to the brassiere 100 (FIGS. 1A-1I) and brassiere 200 (FIGS. 2A-2D). Similar or even identical features are identified in FIG. 3A by the same references numbers as used in the previously described Figures. In the interest of conciseness, only some significant differences between the implementations are discussed below.

The brassiere 300*a* has a front closure 350*a* where there is a selectively closeable break in the front bust portion 102 and, or the frame, for example at a bridge 242. The front closure 350*a* includes one or more selectively releasable fasteners 352*a*, 352*b*, for example fabric hook and loop fastener. The fasteners 352*a*, 352*b* are preferably of an inert, non-toxic material, for instance various natural fibers or cellulose.

Figure 3B:
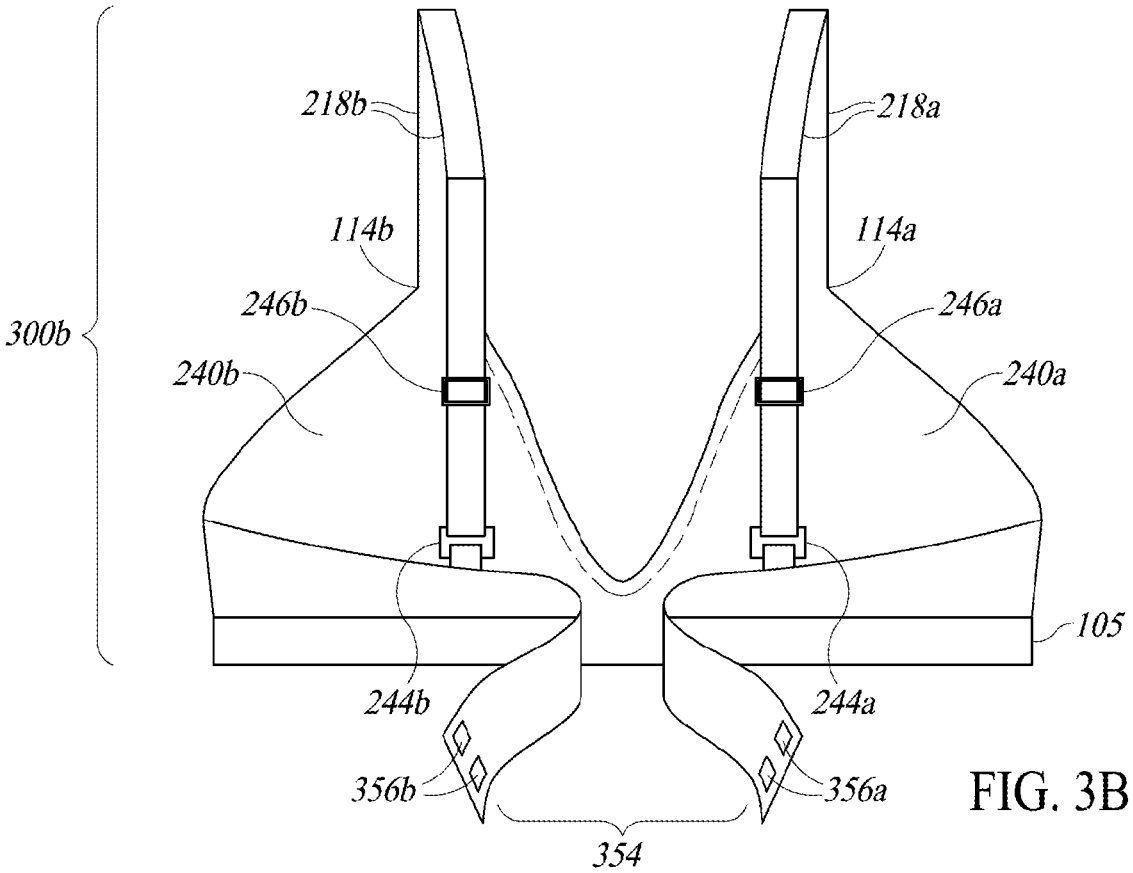
FIG. 3B is a rear elevational view of a garment in the form of a brassiere having a rear opening or closure and associated fasteners, to at least one illustrated embodiment.

FIG. 3B show a brassiere 300*b*, according to at least one illustrated embodiment. The brassiere 300*b* is similar in many respects to the brassiere 100 (FIGS. 1A-1I) and brassiere 200 (FIGS. 2A-2D). Similar or even identical features are identified in FIG. 3B by the same references numbers as used in the previously described Figures. In the interest of conciseness, only some significant differences between the implementations are discussed below.

The brassiere 300*b* has a rear or back closure 354 where there is a selectively closeable break in the band 105 or wings 104. The rear or back closure 354 includes one or more selectively releasable fasteners 356*a*, 356*b*, for example hooks and eyes, snaps, or buttons and button holes. The fasteners 356*a*, 356*b* are preferably of an inert, non-toxic material, for instance various natural fibers or cellulose.

FIGS. 4A-4G show a garment in the form of a brassiere 400 in a third style, according to at least one illustrated embodiment. The brassiere 400 is similar in many respects to the brassiere 100 (FIGS. 1A-1I), brassiere 200 (FIGS. 2A-2D), brassiere 300*a* (FIG. 3A), and, or brassiere 300*b* (FIG. 3B). Similar or even identical features are identified in FIGS. 4A-4D by the same references numbers as used in the previously described Figures. In the interest of conciseness, only some significant differences between the implementations are discussed below.

The brassiere 400 has a front bust portion 102, wing portion 104, under band 105, stitching 106, with an extended portion 102*a* of the front bust portion 102 attached to a Y-shaped back strap 418, with armholes 460*a*, 460*b* to receive a wearer's arms therethrough when the brassiere 400. The brassiere 400 resembles a halter top.

Figure 4A:
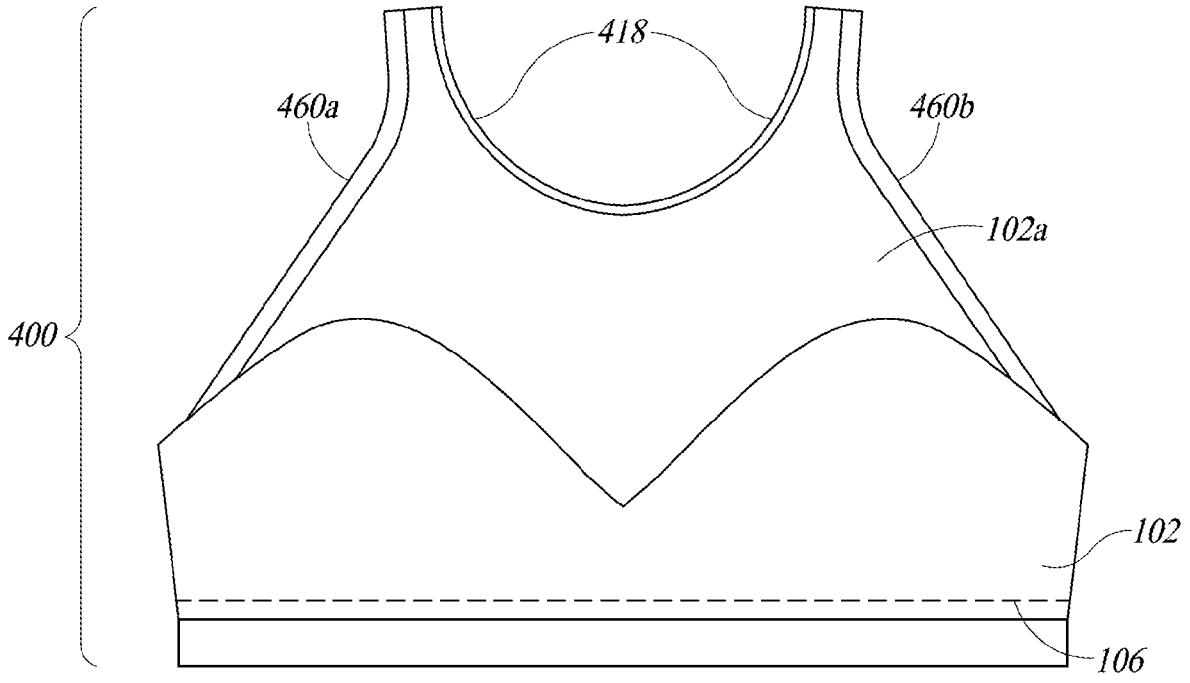
FIG. 4A is a front elevational view of a garment in the form of a brassiere in a third style, having a front bust portion, a band, stitching, and optional straps, according to at least one illustrated embodiment.
Figure 4B:
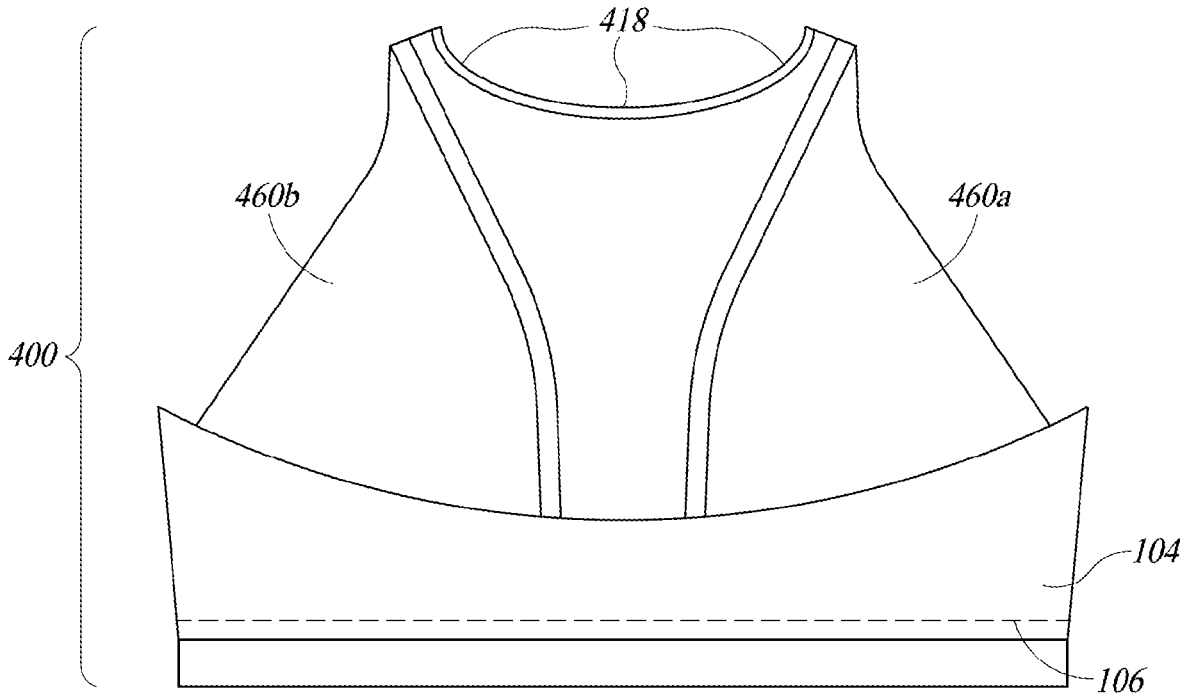
FIG. 4B is a rear elevational view of the brassiere of FIG. 4A.
Figure 4C:
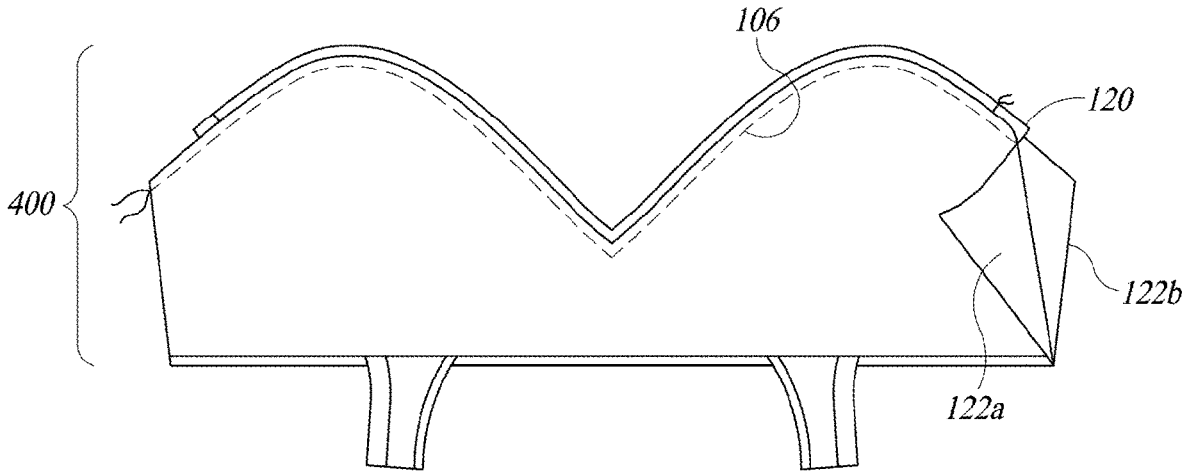
FIG. 4C is a partial front elevational view of the brassier of FIG. 4A with a number of layers separated to better illustrate a construction thereof, including an elastomer layer sandwiched between a pair of textile or fabric layers.
Figure 4D:
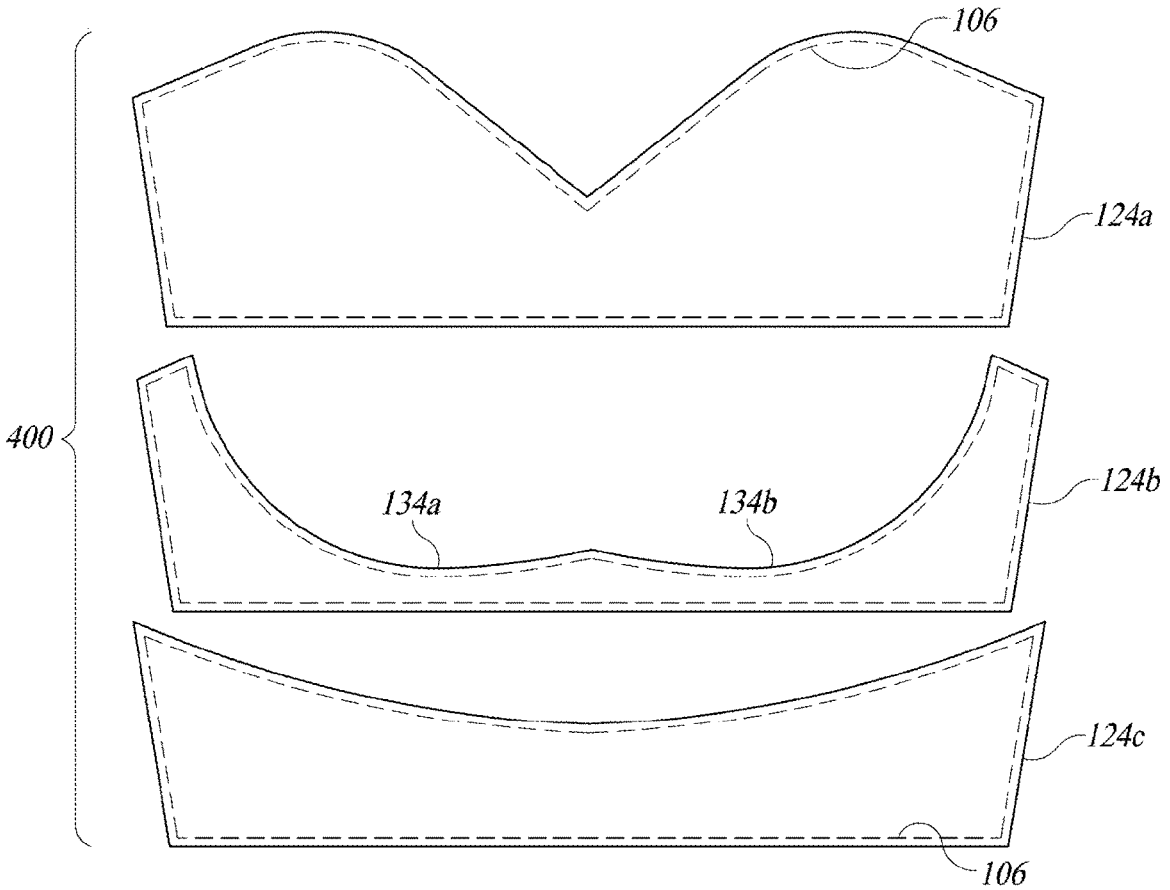
FIG. 4D is a pattern for an elastomer seamless panel or sheet of the front bust portion and wing portion of the brassiere of FIG. 4A, which forms one layer of the front bust portion and one layer of the wings, according to at least one illustrated embodiment.
Figure 4E:
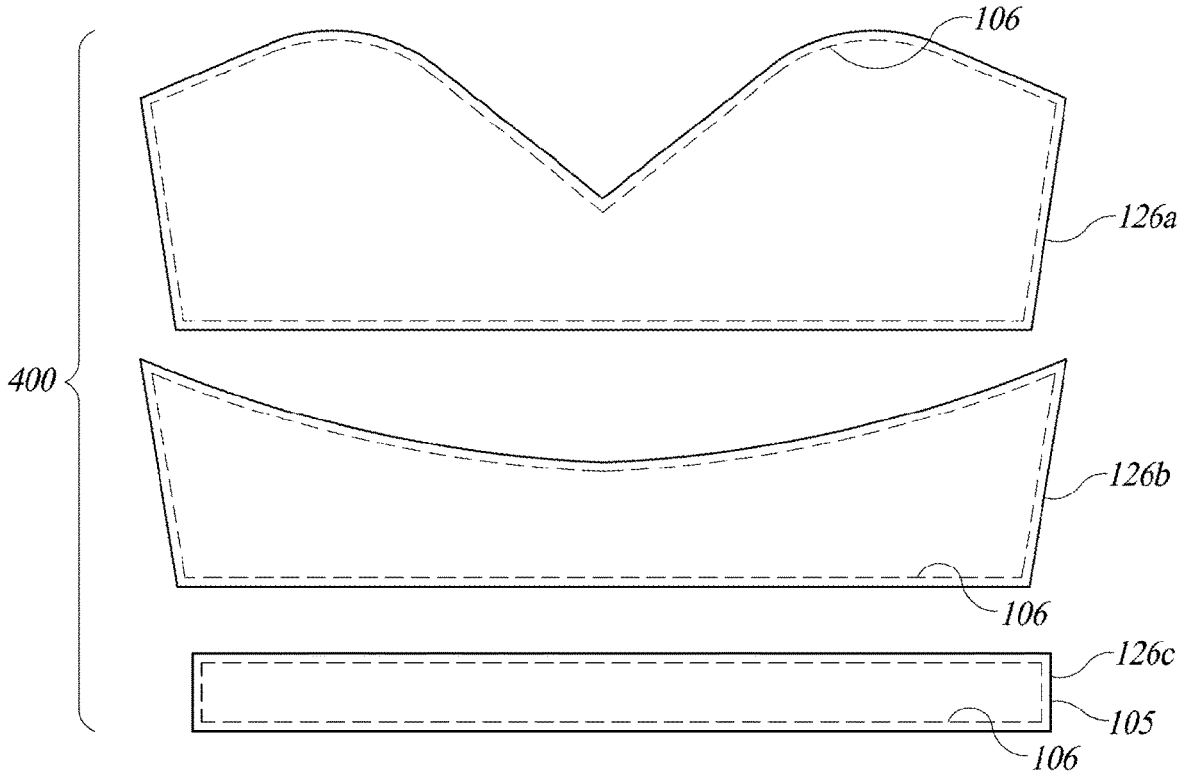
FIG. 4E is a pattern for an outermost seamless textile or fabric panel or sheet of the front bust portion and wing portion, and an outermost seamless textile or fabric panel or sheet of an under band portion of the brassiere of FIG. 4A, which forms one layer of the front bust portion and one layer of the under band, according to at least one illustrated embodiment.
Figure 4F:
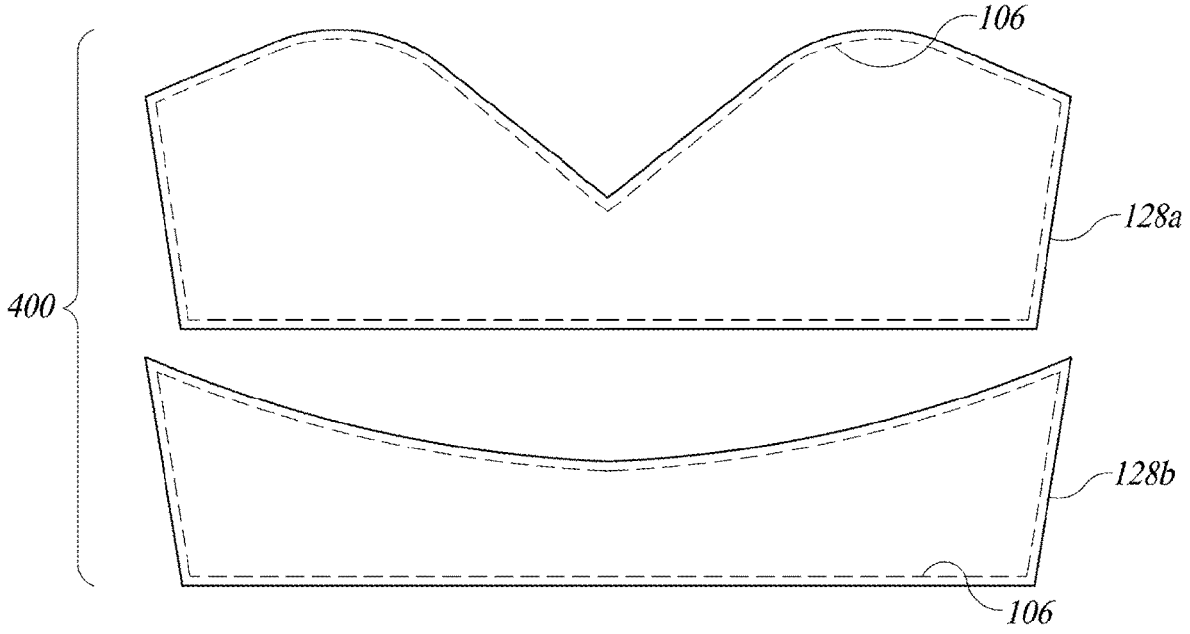
FIG. 4F is a pattern for an innermost seamless textile or fabric panel or sheet of the front bust portion and wing portion of the brassiere of FIG. 4A, which forms one layer of the front bust portion and one layer of the wings, according to at least one illustrated embodiment.

With reference to FIG. 4C, the brassiere 400 may be made of two or more layers, including at least one inert, non-toxic, elastomer layer 120 and one or more natural textile or fabric layers 122*a*, 122*b* (collectively 122). The inert, non-toxic, elastomer layer 120 may include one or more inert and, or non-toxic elastomer panels or sheets, for example silicone panels or sheets, and more advantageously compressed silicone panels or sheets 124*a*, 124*b*, 124*c* (FIG. 4D). The silicone panels or sheets or compressed silicone panels or sheets 124*a*, 124*b*, 124*c*, are silicone substrates or sheets, in contrast to textiles or fabrics that are coated with silicone or in which silicone has been infused or injected. The natural textile or fabric layers 122*a*, 122*b* include one or more natural, non-toxic, textile or fabric panels or sheets 126*a*, 126*b*, 126*c*, 128*a*, 128*b* (FIGS. 4E, 4F). In particular, a first natural, non-toxic, textile or fabric panels or sheets 126*a* may form an outermost layer of the front bust portion 102, while a second natural, non-toxic, textile or fabric panels or sheets 126*b* may form an outermost layer of the wing portion 104. In particular, a third natural, non-toxic, textile or fabric panels or sheets 128*a* may form an innermost layer of the front bust portion 102, while a fourth natural, non-toxic, textile or fabric panels or sheets 128*b* may form an outermost layer of the wing portion 104. A fifth natural, non-toxic, textile or fabric panels or sheets 126*c* may form the under band 105. The natural textile or fabric panels or sheets 126*a*, 126*b*, 126*c*, 128*a*, 128*b* (FIGS. 4E, 4F) may for example include one or more of silk, linen, organic cotton, and, or bamboo fiber panels or sheets 122.

With reference to FIGS. 4D-4F, the two or more layers, including at least one inert elastomer layer 120 and one or more natural textile or fabric layers 122*a*, 122*b* of the brassiere 400 may be attached or secured to one another via a plurality of stitches 106 via one or more strands of threads, for example a natural, organic thread. The plurality of stitches 106 physically couple the at least one inert or non-toxic elastomeric sheet or panel 124*a*, 124*b*, 124*c* (FIG. 4D) with the at least one natural textile or fabric sheets or panels 126*a*, 126*b* (FIG. 4E), 128*a*, 128*b* (FIG. 4F) to form the front bust portion 102, the wings 104, and, or band 105.

Figure 4G:
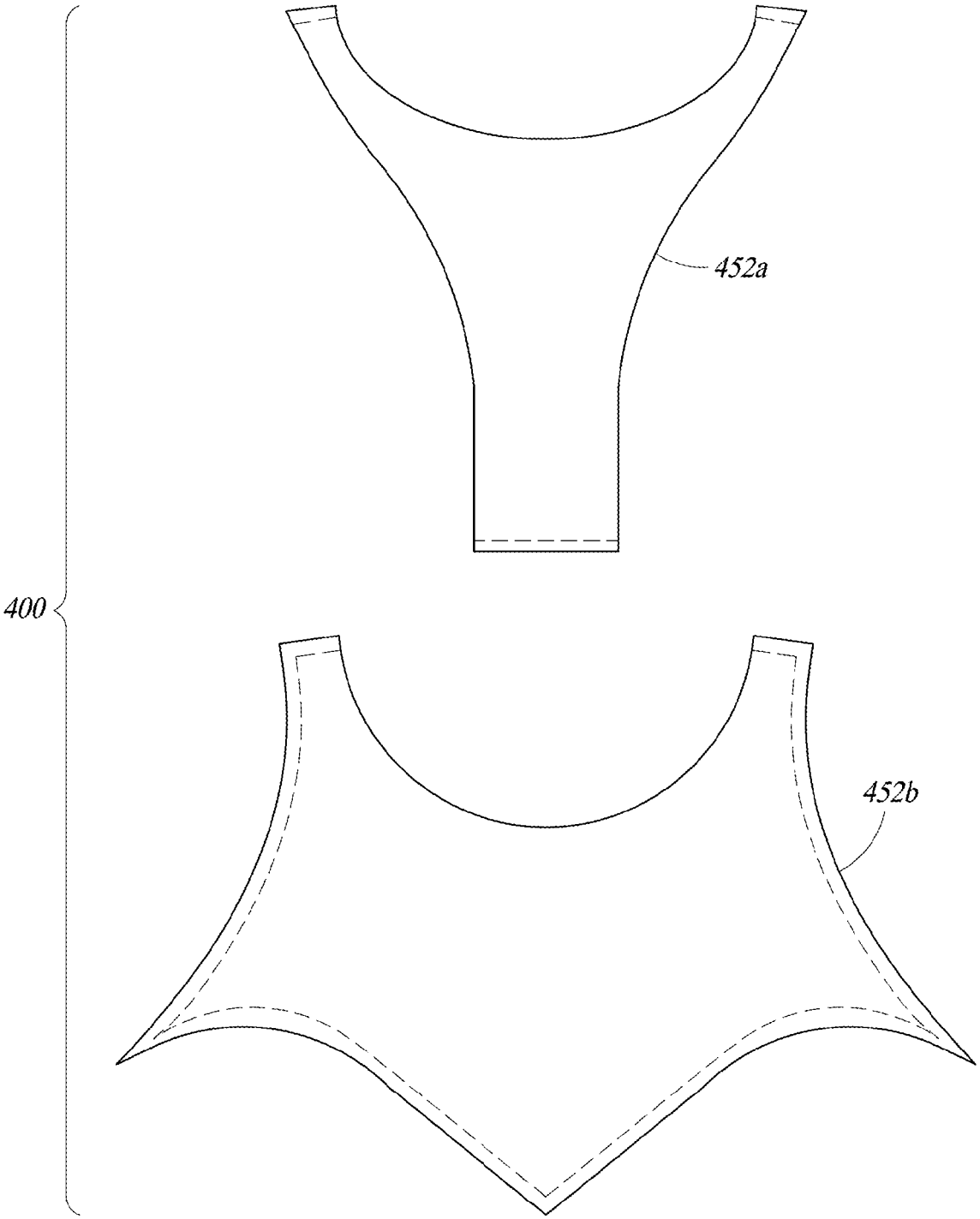
FIG. 4G is a pattern for optional mesh portions of the brassiere of FIG. 4A, according to at least one illustrated embodiment.

With reference to FIG. 4G, a pair of mesh panels 452*a*, 452*b* may form a portion of the brassiere 400. The mesh panels may, for example, take the form of inert or non-toxic elastomeric sheets or panels, or may take the form of non-toxic, natural, or even organic, textile or fabric sheets or panels. to form the front bust portion 102, the wings 104, and, or band 105. One of the mesh panels 452*a* may form the Y-shaped back strap 418. The other one of the mesh panels 452*a* may extend up from the front bust portion 102. The armholes 460*a*, 460*b* may be formed by the mesh panels 452*a*, 452*b*.

Any of the above described implementations or embodiments may advantageously employ medical grade sheets (e.g., sheets of medical grade silicone) which can contact, or even directly adhere, to the skin, for example imposed between textile fabric and the skin. Such may advantageously promote healing of skin tissue, reducing or eliminating scars and/or wrinkles, and provide other therapeutic benefits. Such medical grade silicone sheets may self-adhere to skin or may include a layer of a pressure-sensitive adhesive. For example, silicone (e.g., polysiloxanes) gels securely adhere to skin, for instance a cured silicone sheet may be employed with a silicone gel layer, or a partially-cured silicone sheet may be employed. Also for example, various bio-compatible adhesives may be employed. The medical grade silicone sheets may be separate from the remainder of the garment. The medical grade silicone sheets may be selectively removably detachable from the remainder of the garment. For example, a garment kit may include one or more disposable or washable medical grade silicone sheets along with an instance of the remainder of the garment. Replacement medical grade silicone sheets may be sold separately. Alternatively, the medical grade silicone sheets may be integral to the garment.

The above description of illustrated embodiments, including what is described in the Abstract, is not intended to be exhaustive or to limit the various embodiments to the precise forms disclosed. Although specific embodiments of and examples are described herein for illustrative purposes, various equivalent modifications can be made without departing from the spirit and scope of the disclosure, as will be recognized by those skilled in the relevant art.

The teachings provided herein can be applied to any style of brassiere, not just the styles illustrated. For example, the teachings can be applied to full-coverage brassieres, seamless brassieres, demi brassieres, push-up brassieres, minimizer brassieres, plunge brassieres, balconette brassieres, bralettes, strapless brassieres, bandeau brassieres, long-line brassieres, sports brassieres, adhesive brassieres, nursing brassieres, maternity brassieres, and, or mastectomy brassieres. The teachings provided herein can be applied to other garments, not just the various types of foundation garments and brassieres illustrated and described herein. For instance, the elastomer (e.g., silicone, compressed silicone) sheets may be used long pants, short pants, leggings, undergarments, etc.

U.S. Provisional Patent Application No. 62/552,219, filed Aug. 30, 2017, to which the present application claims priority, is hereby incorporated herein by reference in its entirety. The various embodiments described above can be combined to provide further embodiments. Aspects of the embodiments can be modified, if necessary, to employ systems, circuits and concepts of the various patents, applications and publications to provide yet further embodiments.

These and other changes can be made in light of the above-detailed description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure.

The invention claimed is:

1. A brassiere, comprising:

at least one non-toxic elastomeric sheet, at least one non-toxic textile sheet, and a plurality of stitches that physically couple the at least one non-toxic elastomeric sheet with the at least one non-toxic textile sheet, the at least one non-toxic elastomeric sheet and the at least one non-toxic textile sheet which form a front bust portion and a band, the front bust portion which includes at least one panel sized and dimensioned to retain a pair of breasts when the brassiere is worn, and the band which physically couples opposed laterally spaced apart ends of the front bust portion together when the brassiere is worn.

2. The brassiere of claim 1 wherein the at least one non-toxic elastomeric sheet forms a multiple ply elastomeric sling, with a pair of concave portions that extend along a bottom edge of the front bust portion, and which concave portions of the multiple ply sling underlie and support respective breasts when the brassiere is worn.

3. The brassiere of claim 2 wherein the at least one non-toxic elastomeric sheet is a silicone sheet.

4. The brassiere of claim 1 wherein the at least one non-toxic elastomeric sheet is at least one compressed silicone sheet.

5. The brassiere of claim 4 wherein the at least one compressed silicone sheet forms a multiple ply silicone sheet frame that includes multiple plies of silicone sheet.

6. The brassiere of claim 4 wherein the at least one compressed silicone sheet forms a multiple ply silicone sheet frame that includes multiple plies of silicone sheet without any underwire.

7. The brassiere of claim 4 wherein the at least one compressed silicone sheet includes a first compressed silicone sheet and a second silicone sheet, the first compressed silicone sheet which forms a frame of multiple plies of silicone sheet without any underwire, and the second compressed silicone sheet which extends upward to a pair of spaced apart apexes.

8. The brassiere of claim 4 wherein the at least one compressed silicone sheet includes a first compressed silicone sheet, a second compressed silicone sheet, and a third compressed silicone sheet, the first compressed silicone sheet which forms a frame of multiple plies of silicone sheet without any underwire, the second compressed silicone sheet which extends upward to a first apex, and the third compressed silicone sheet which extends upward to a second apex, the second apex spaced laterally apart from the first apex at least when the brassiere is worn.

9. The brassiere of claim 8 wherein the first, the second and the third compressed silicone sheets are each seamless.

10. The brassiere of claim 8, further comprising:

at least a first strap, the first strap which extends from the first apex to the band.

11. The brassiere of claim 4 wherein the at least one compressed silicone sheet includes a first compressed silicone sheet, a second compressed silicone sheet, a third compressed silicone sheet, and a fourth compressed silicone sheet, the first compressed silicone sheet which forms a multiple ply frame of multiple plies of silicone sheet without any underwire, the second compressed silicone sheet which extends upward to a first apex to at least partially cover a first breast when worn, and the third compressed silicone sheet which extends upward to a second apex to at least partially cover a second breast when worn, the second apex spaced laterally apart from the first apex at least when the brassiere is worn, and the fourth compressed silicone sheet which forms the band.

12. The brassiere of claim 1 wherein the at least one non-toxic textile sheet includes a self sheet and a lining sheet, the at least one silicone sheet is sandwiched between the self sheet and the lining sheet.

13. The brassiere of claim 12 wherein the at least one textile sheet is a natural material.

14. The brassiere of claim 12 wherein the at least one textile sheet is comprises at least one of silk, linen, organic cotton, and bamboo fiber.

15. The brassiere of claim 12 wherein the front bust portion includes a first cup and a second cup, the first and the second cups being non-molded cups.

16. The brassiere of claim 15 wherein the front bust portion includes a bridge that physically couples the first and the second cups together.

17. The brassiere of claim 12, further comprising:

at least one selectively releasable fastener positioned in the front bust portion between the breasts.

18. The brassiere of claim 12, further comprising:

at least one selectively releasable fastener positioned in the band.

19. The brassiere of claim 12 wherein the front bust portion and the band provide a continuous piece without a closure.

20. The brassiere of claim 12 wherein the entire brassiere is devoid of any metal and devoid of any toxic materials.

* * * * *